United States Patent [19]

Kimura et al.

[11] 4,201,106

[45] May 6, 1980

[54] ELECTRONIC MUSICAL INSTRUMENT

[75] Inventors: Takeji Kimura, Hirakata; Toyoki Takemoto, Tsuzuki; Michihiro Inoue, Hirakata; Masaharu Sato, Moriguchi, all of Japan

[73] Assignee: Matsushita Electric Industrial Co., Ltd., Kadoma, Japan

[21] Appl. No.: 799,316

[22] Filed: May 23, 1977

[30] Foreign Application Priority Data

| | | | |
|---|---|---|---|
| May 24, 1976 | [JP] | Japan | 51-59137 |
| Dec. 20, 1976 | [JP] | Japan | 51-153999 |
| Mar. 2, 1977 | [JP] | Japan | 52-22947 |
| Mar. 14, 1977 | [JP] | Japan | 52-28176 |

[51] Int. Cl.[2] ..... G10H 3/00; G10H 1/02

[52] U.S. Cl. ..... 84/1.09; 84/1.26; 84/1.27; 84/DIG. 7

[58] Field of Search ..... 84/1.01, 1.03, 1.09, 84/1.1, 1.13, 1.11, 1.19, 1.24, 1.26, DIG. 7, DIG. 8, DIG. 11

[56] References Cited

U.S. PATENT DOCUMENTS

| | | | |
|---|---|---|---|
| 3,562,400 | 2/1971 | Cutler | 84/1.26 |
| 3,760,358 | 9/1973 | Isii et al. | 84/1.01 X |
| 3,784,718 | 1/1974 | Uchitama | 84/1.13 |
| 3,916,750 | 11/1975 | Uetrecht | 84/1.01 |
| 3,929,051 | 12/1975 | Moore | 84/1.17 |
| 3,955,460 | 5/1976 | Southard | 84/1.17 |
| 4,070,943 | 1/1978 | Faulkner | 84/1.01 |
| 4,083,286 | 4/1978 | Faulkner | 84/1.26 |

*Primary Examiner*—Vit W. Miska

*Attorney, Agent, or Firm*—Wenderoth, Lind & Ponack

[57] ABSTRACT

The present invention is an electronic musical instrument the type in which information of the actuation of keys is detected by scanning the keys of a keyboard. The electronic musical instrument includes keys selectively actuable for producing sounds which correspond to respective musical scale notes, circuitry for sequentially scanning these keys for detection of the information of the actuation of these keys, and a memory circuit corresponding to each of the keys so that the information of the actuation of the keys is stored in the memory circuits.

16 Claims, 16 Drawing Figures

Figure 1:
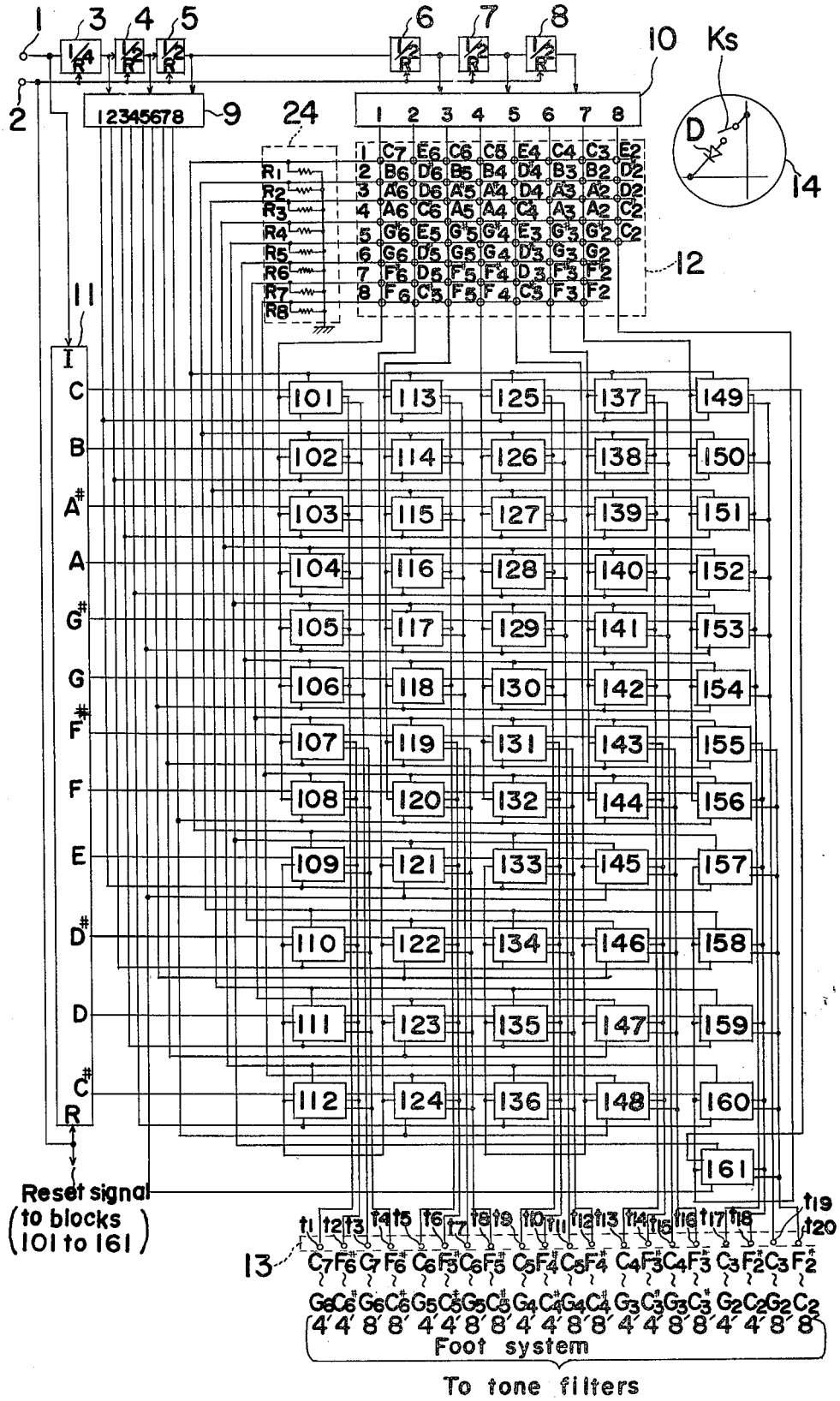

1
2
3
5
6
7
8
10
19
24
26
25
20
11
13
1/4 R
1/2 R
0 1 2 3
P0 P1 P2 P3 P4 P5 P6 P7
R0 R1 R2 R3 R4 R5 R6 R7 R8 R9 R10 R11
OSC IN
R IN
C B A# A G# G F# F E D# D C#
401 402 403 404 405 406 407 408 409 410 411 412
413 414 415 416 417 418 419 420 421 422 423 424
425 426 427 428 429 430 431 432 433 434 435 436
437 438 439 440 441 442 443 444 445 446 447 448
449 450 451 452 453 454 455 456 457 458 459 460
461 462 463 464 465 466 467 468 469 470 471 472
473 474 475 476 477 478 479 480 481 482 483 484
485 486 487 488
C6 F#7 C7 F#6 C6 F#5 C5 F#4 C4 F#3 C3 F#2 C2 F#1 C1
G7 C#7 G6 C#6 G5 C#5 G4 C#4 G3 C#3 G2 C#2 G1 C#1 A0
To tone filters

ELECTRONIC MUSICAL INSTRUMENT

The present invention relates to electronic musical instruments and more particularly, to electronic musical instruments such as electronic organs, electronic pianos, electronic accordions and the like employing system wherein information of the actuation of keys is detected by scanning the keys of a keyboard.

Conventionally, there have been proposed various arrangements in an attempt to form the complicated tone generator circuits, keyboard circuits, etc. of electronic musical instruments, electronic organs for example, into large scale integrated circuits (called LSI hereinbelow). Each of these arrangements, however, is still a complicated and large scale a system, generally requiring several LSI elements. For the electronic organs of the type in which the keys of a keyboard are scanned, there has been disclosed one system in U.S. Pat. No. 3,610,799 entitled "Multiplexing system for selection of notes and voices in an electronic musical instrument", in which the acutation of the keys is encoded as a time-division multiplex (TDM) signal on a single line, in which a unique position on the time axis corresponds to each of the keys. The information of the actuation of the keys thus formed into a time-division multiplex signal is sequentially memorized and retained in each of the circuits which employs a modulo counter or the like, constituted by a shift resistor of 384 stages for example. Accordingly, in the conventional electronic musical instrument of the above described type in which the keys depressed are sequentially assigned to a tone generator, not only are considerably complicated circuits required for memorizing information of the actuation of a key, but circuits of complex construction as described earlier are inevitably necessary for such assignments, thus resulting in potential causes of troubles and failure as well as an increase in the cost and difficulty of servicing Accordingly, an essential object of the present invention is to provide an electronic musical instrument of keyboard scanning type having circuit construction suitable for integration into one chip, particularly the keyboard circuits and the tone generators thereof, in which the information of the actuation of the keys is memorized and retained by an extremely simple circuit arrangement.

Another important object of the present invention is to provide an electronic musical instrument of the above described type in which a memory means corresponding to each of the keys of the keyboard is provided for storing therein the information of the actuation of the keys.

A further object of the present invention is to provide an electronic musical instrument of the above described type in which the key switches are arranged in matrix form for connection, while control of the envelope of the notes is effected at will and moreover, the magnitude of the notes can be varied according to the speed of depression of the keys.

A still further object of the present invention is to provide an electronic musical instrument of the above described type wherein the mode can be changed over from a mode in which the tone stops when the depressed key is released to a mode in which a decreasing tone remains even after the release of the depressed keys.

Another object of the present invention is to provide an electronic musical instrument of the above described type in the mode can be changed over from a piano mode wherein the magnitude of the tone varies according to the speed of depression of the keys with the envelope of the tone decreasing from start of depression of the keys to an organ mode wherein the magnitude of the tone does not vary according to the speed of depression of the keys and the envelope of the tone is kept constant during depression of the keys.

A further object of the present invention is to provide an electronic musical instrument of the above described type which is accurate and stable in function, and which can be produced at a low cost by simplification of construction.

In accomplishing these and other objects, according to the present invention, the electronic musical instrument, embodied herein in the form of an electronic organ of the type in which information of actuation of keys is detected by scanning the keys of a keyboard, includes selectively acutable keys for producing sounds which correspond to respective musical scale notes, means for sequentially scanning the keys for detection of the information of the actuation of these keys, and memory means corresponding to each of the keys so that the information of the actuation of the keys is stored in the memory means. An electrical capacitance, a latch circuit etc., are employed for the memory means and envelope; information or the like is stored by memorizing analog information. Since the keyboard circuits and the tone generators of the musical instrument according to the present invention are not only simple in construction but particularly suitable for formation into integrated circuits such as LSI, they can be readily incorporated, for example, into an electronic organ with substantial elimination of the disadvantages inherent in the conventional electronic musical instruments.

Figure 2:
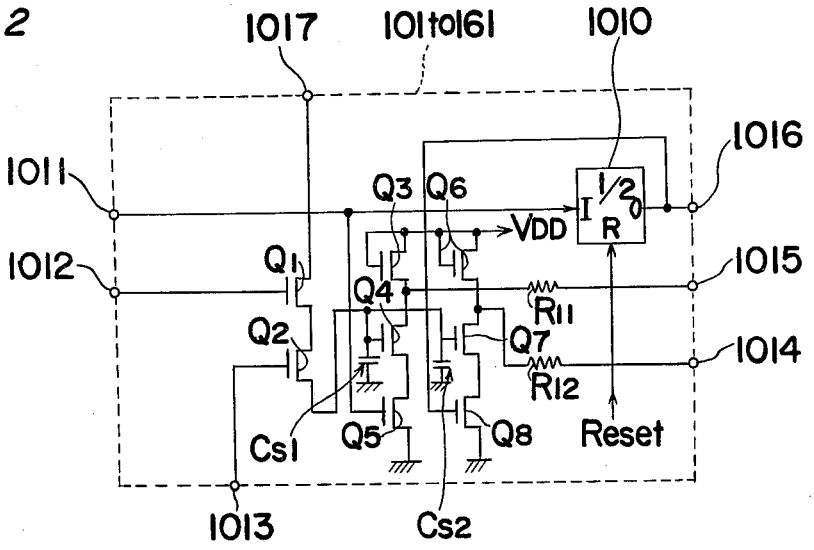
Figure 3:
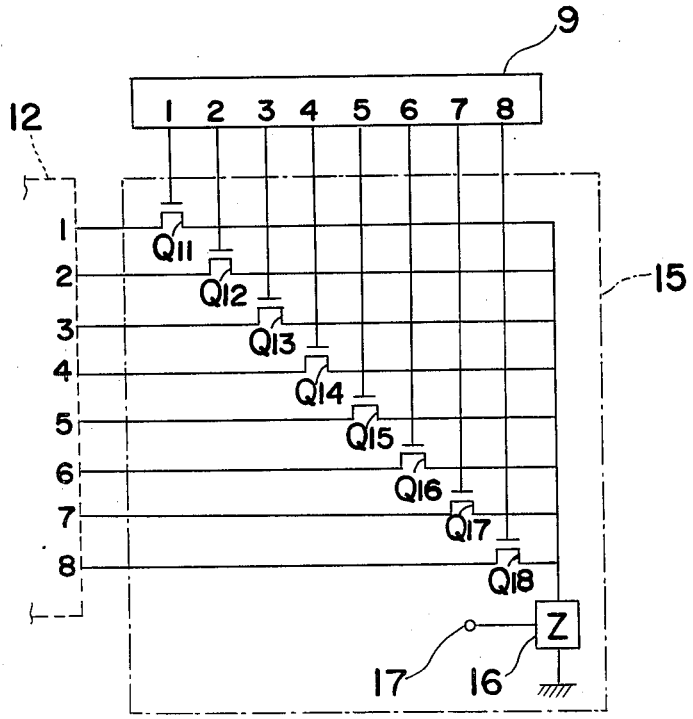
Figure 4:
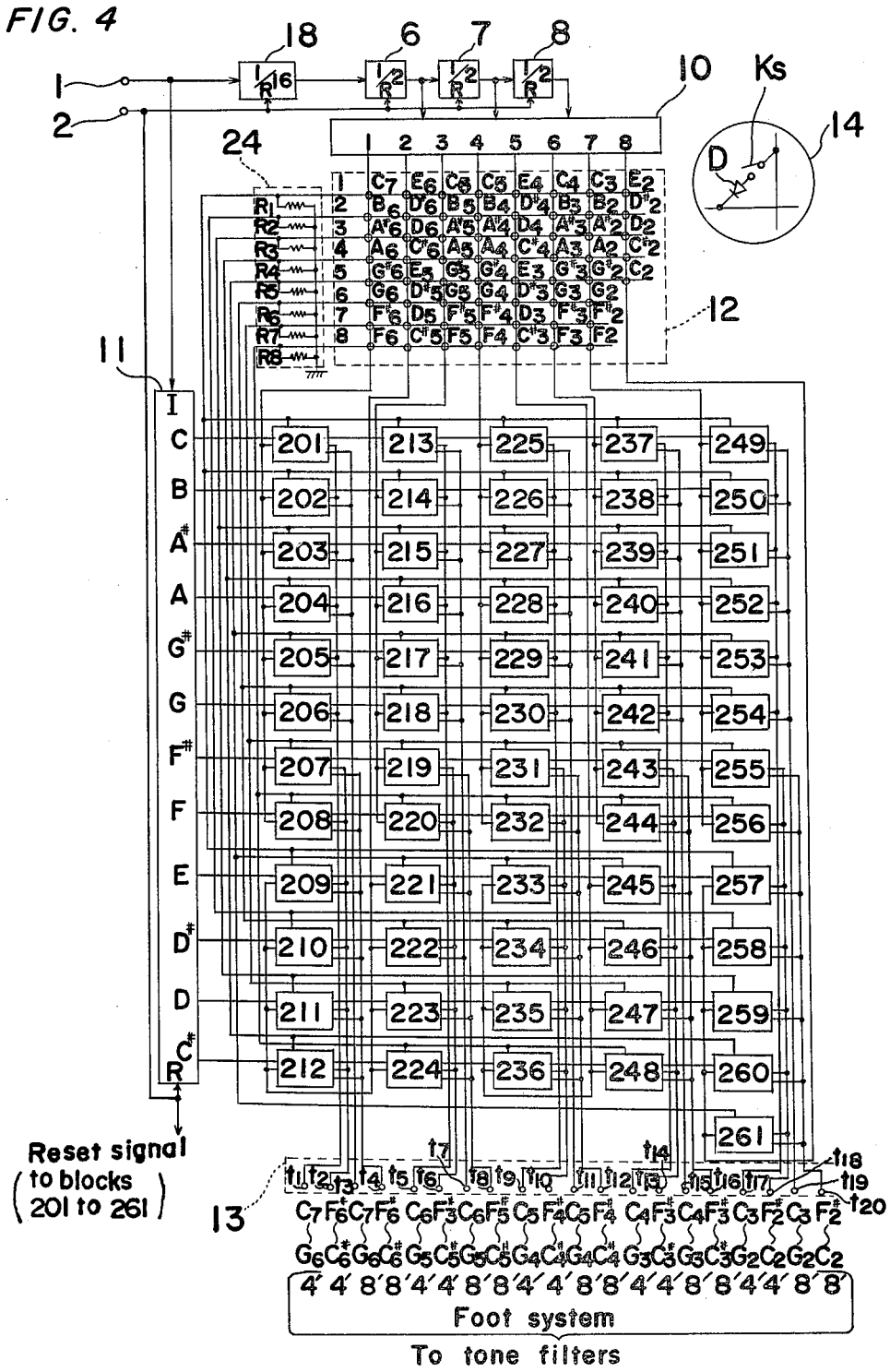
Figure 5:
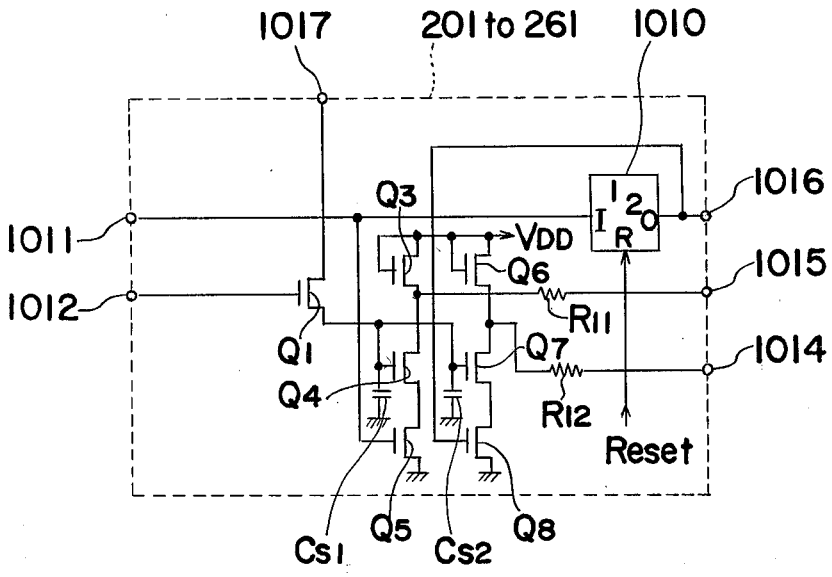
Figure 6:
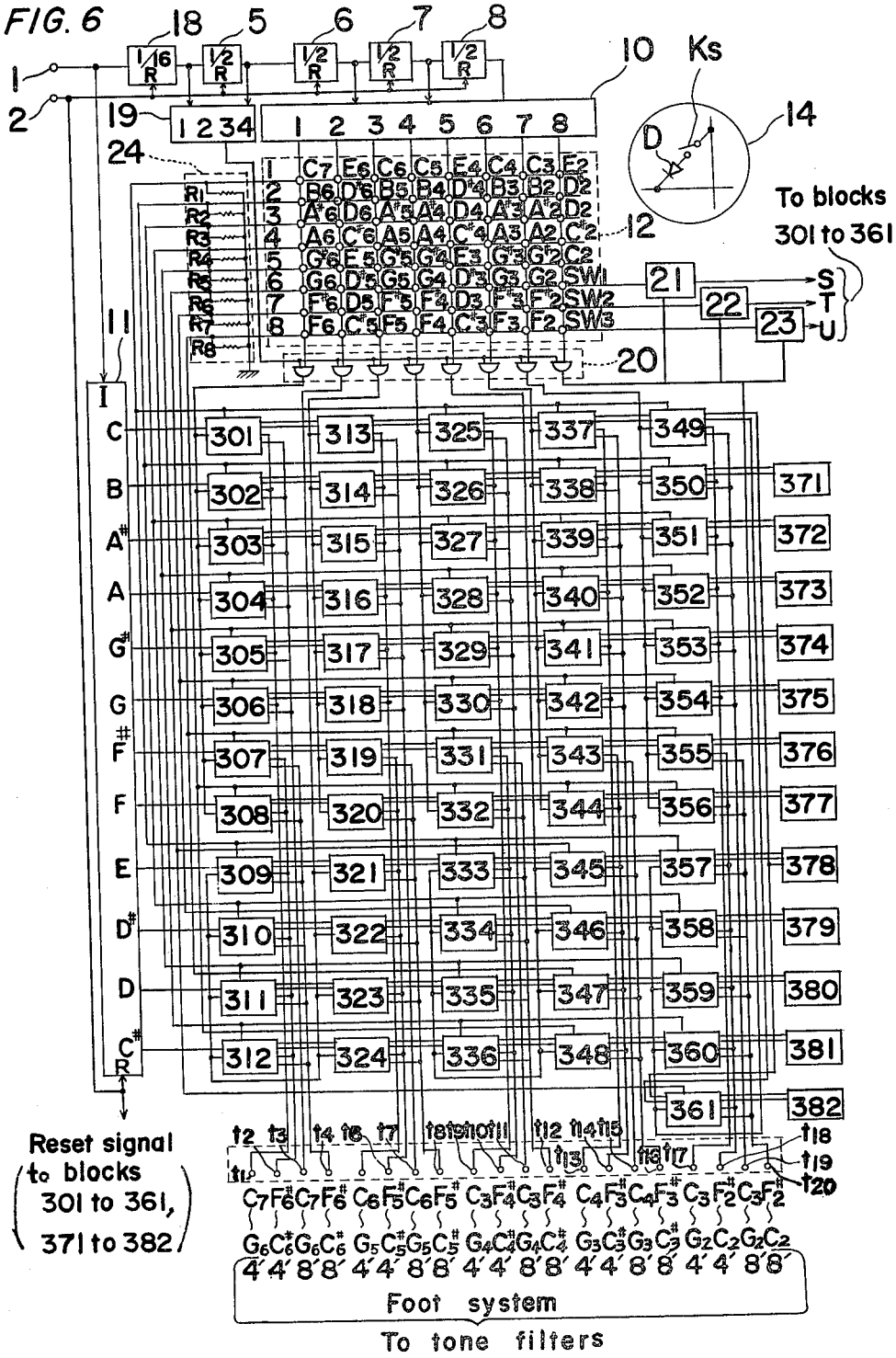
Figure 7:
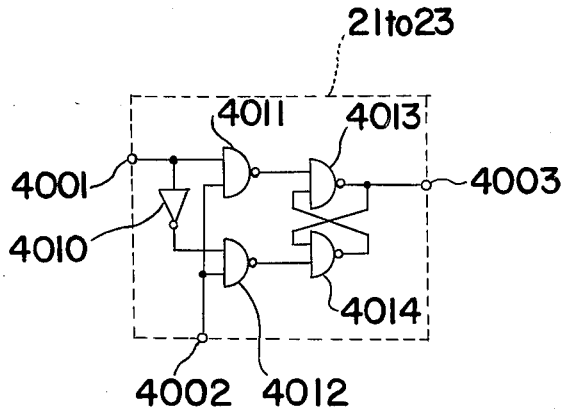
Figure 8:
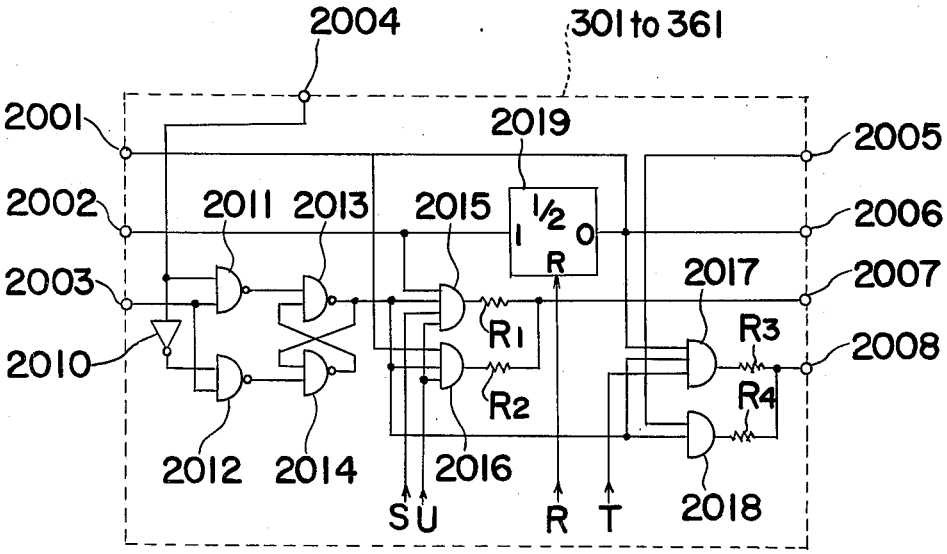
Figure 9:
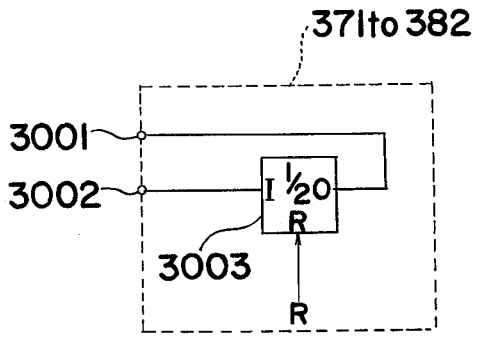
Figure 10:
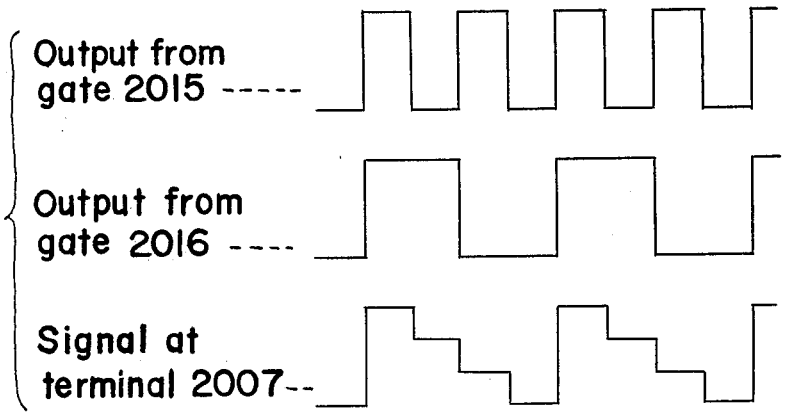
Figure 11:
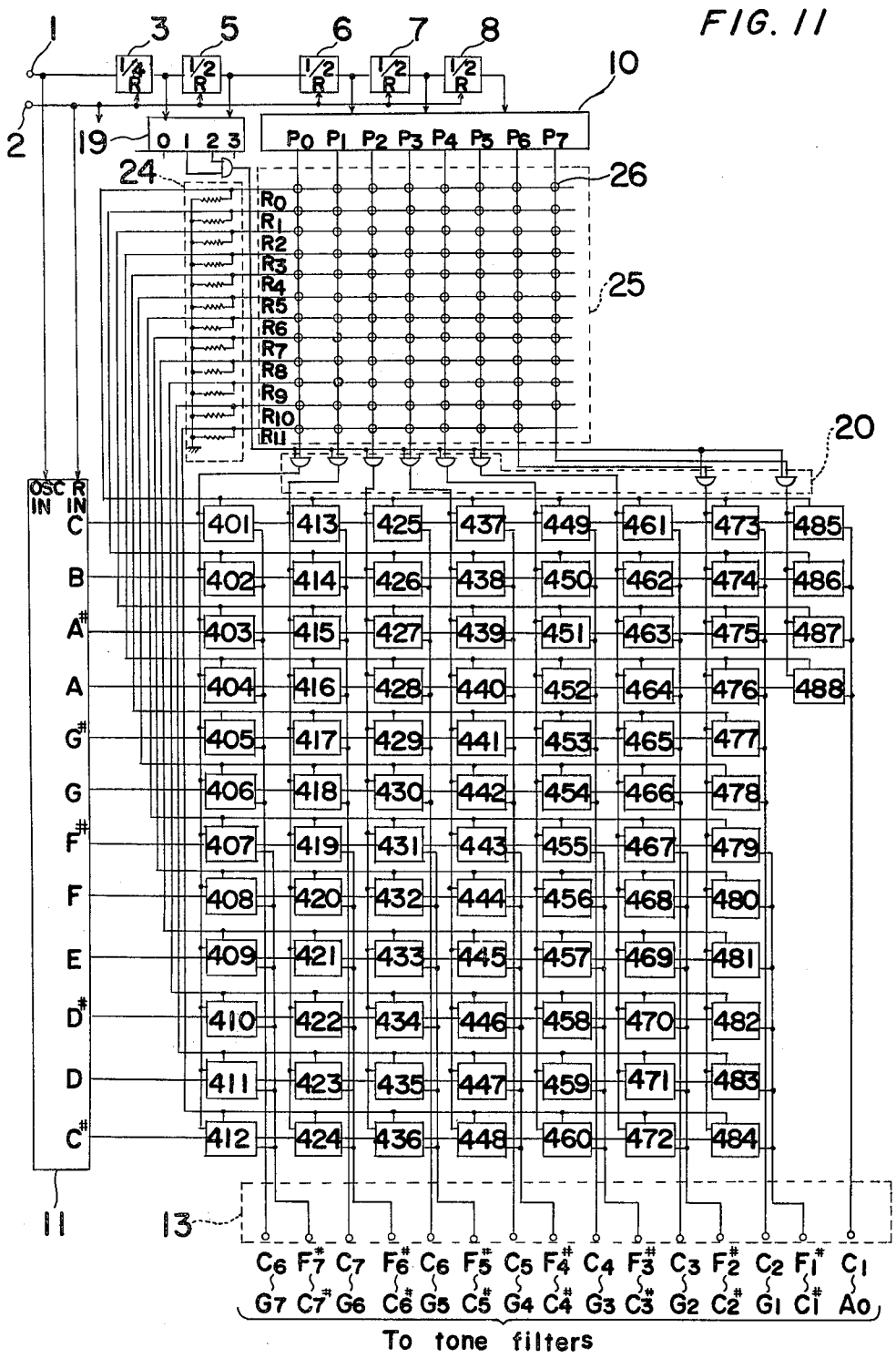
Figure 12:
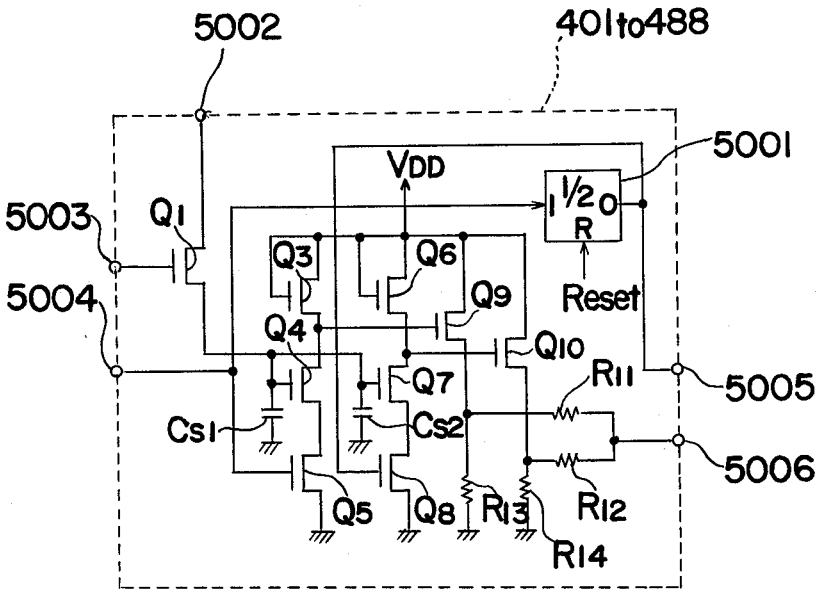
Figure 13:
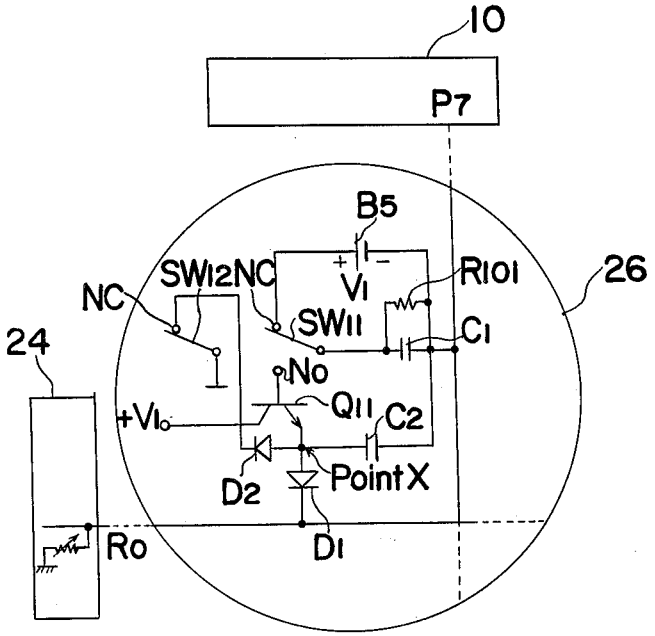
Figure 14:
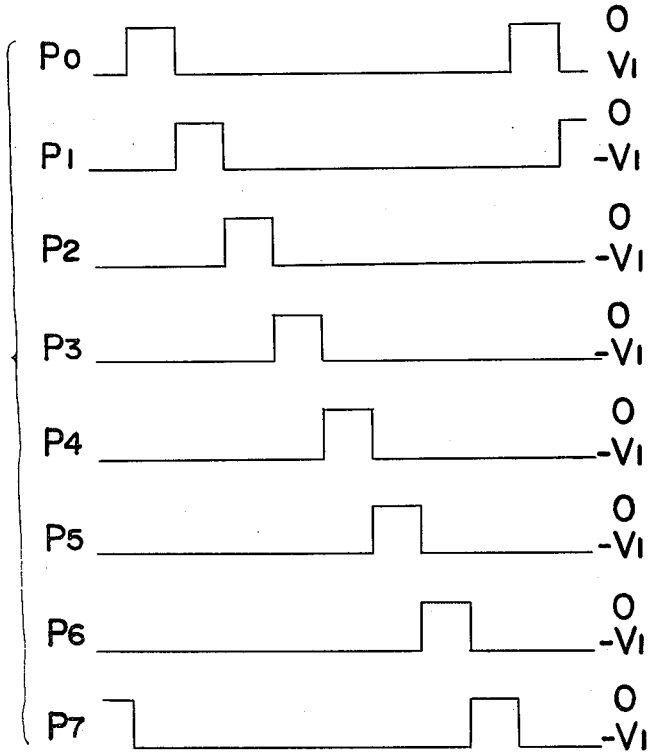
Figure 15:
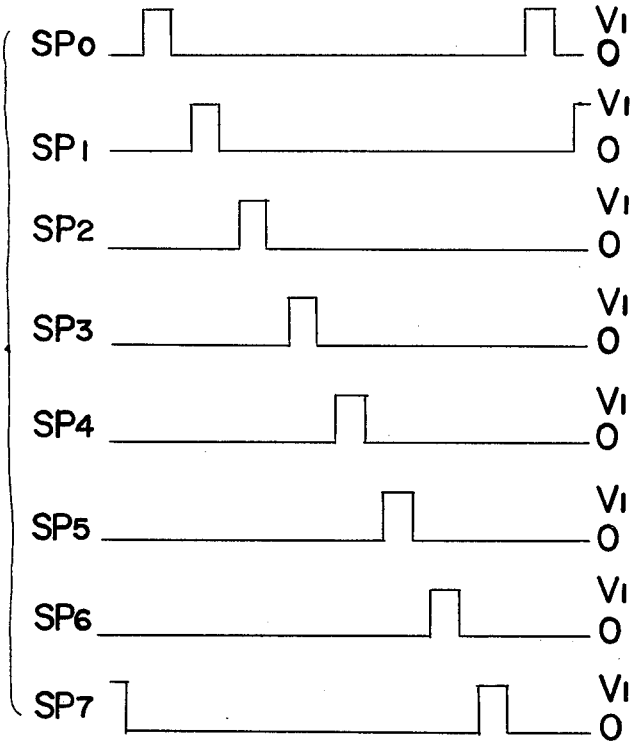
Figure 16:
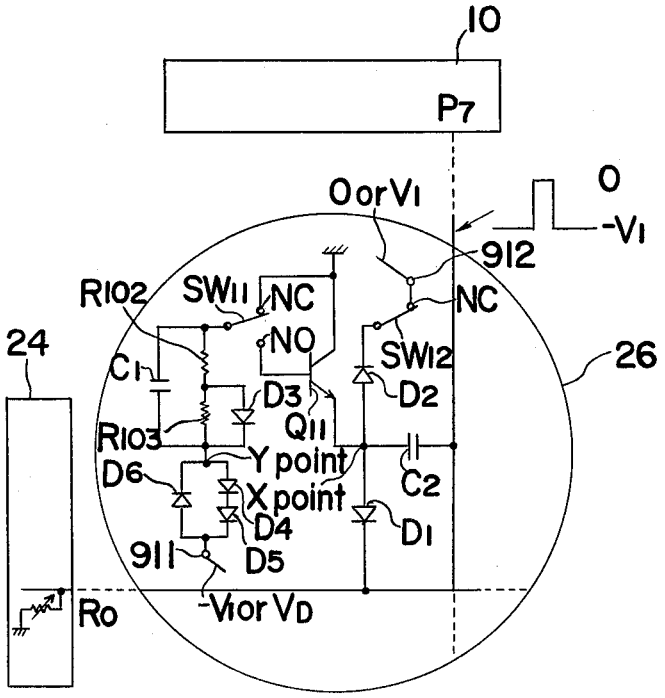

These and other objects and features of the present invention will become apparent from the following description taken in conjunction with the preferred embodiment thereof with reference to the attached drawings, in which;

FIG. 1 is a schematic block diagram of the keying and tone generator circuits of an electronic organ according to one preferred embodiment of the present invention, FIG. 2 is an electrical circuit diagram showing one example of the circuit arrangement in each of the blocks employed in the circuit of FIG. 1, FIG. 3 is a schematic diagram showing a circuit which may be added to the circuits of FIG. 1 for modification of the latter, FIG. 4 is a view similar to FIG. 1, but particularly shows a first modification thereof, FIG. 5 is a schematic diagram showing one example of the circuit arrangement in each of the blocks employed in the circuit of FIG. 4, FIG. 6 is a view similar to FIG. 1, but particularly shows a second modification thereof, FIGS. 7 to 9 are electrical circuit diagrams showing examples of the circuit arrangements for the blocks employed in the circuit of FIG. 6, FIG. 10 illustrates the waveforms of the signals developed at main portions of the circuit of FIG. 8, FIG. 11 is a view similar to FIG. 6, but particularly shows a further modification thereof, FIG. 12 is a circuit diagram showing one example of the circuit arrangement for the blocks employed in the circuit of FIG. 11, FIG. 13 shows, on an enlarged scale, the construction of the keyboard contact and its additional circuit employed in the circuit of FIG. 11, FIGS. 14 and 15 illustrate the waveforms of the signals at main portion of the circuit of FIG. 11, and FIG. 16 is a view similar to FIG. 13, but particularly shows another modification thereof.

Before the description of the present invention proceeds, note that like parts are designated by like reference numerals throughout the several views of the accompanying drawings.

Referring now to the drawings, FIG. 1 shows the tone generator and keying sections of an electronic organ according to a preferred embodiment of the present invention, while FIG. 2 shows the construction of each of the reset blocks 101, 102, 103 . . ., 161 of FIG. 1. In FIG. 1, clock pulses are applied to an input terminal 1 from the output terminal of a clock source (not shown) having a frequency of approximately 2MHz, while reset signals for the frequency dividers 3, 4, 5, 6, 7 and 8 are applied to a rest signal input terminal 2. The $\frac{1}{4}$ frequency divider 3 is constituted, for example, by connecting two $\frac{1}{2}$ frequency dividers in series, while each of the other frequency dividers 4 to 8 is a $\frac{1}{2}$ divider adapted to successively divide the output from the $\frac{1}{4}$ frequency divider 3. A three bit decoder 9 is coupled to the $\frac{1}{4}$ divider 3, the $\frac{1}{2}$ divider 4 and the $\frac{1}{2}$ divider 5 for decoding the outputs from the latter for developing eight progressive pulses. Similarly, a three bit decoder 10 coupled to the $\frac{1}{2}$ dividers 6, 7 and 8 is adapted to decode the outputs of the latter and to develop eight progressive pulses. A top octave divider is connected to the input terminal 1 and develops a signal for the notes of the highest octave by independently dividing the input signal from the input terminal 1 for each note. Meanwhile, a keyboard switch block 12 is inserted between the decoder 10 and the circuit blocks 101, 102, 103, . . ., 161 and has sixty-one keys C7, B6, A#6, A6, G#6, G6, . . ., C2 arranged in positions corresponding to the junctions of a matrix. A circuit 14 having a series-connected keyboard switch Ks and a diode D as shown by way of example in a circle at the upper right of FIG. 1 is connected to each of these junctions. A group of output terminals 13; for connection to the tone filters (not shown) produces output signals each having six notes arranged therein. Each of the circuit blocks 101, 102, 103, . . ., 161 includes a $\frac{1}{2}$ frequency divider 1010 coupled to transistors Q1, Q2, Q3, Q4, Q5, Q6, Q7 and Q8, resistors R11 and R12, and capacitors Cs1 and Cs2 as shown in FIG. 2.

The functions of the tone generator and keying circuits in the above arrangement are described hereinbelow.

From the source signal applied to the input terminal 1, there are produced signals having twelve different frequencies in which the four-foot group fundamental frequencies of the twelve notes of the keys C7 to C#6, i.e., frequencies ranging from approximately 4,186 Hz to 2,218 Hz, are divided by the top octave divider 11 to have a ratio of about $\sqrt[12]{2}$. These signals are supplied to respective terminals 1011 of the circuit blocks 101, 102, 103, ..., 112. The signal thus applied to the terminal 1011 is divided in half by the $\frac{1}{2}$ frequency divider 1010, output from the terminal 1016 and is further applied to the input terminal 1011 of the subsequent block in the next column. In addition, the output from the terminal 1016 of the block 149 is applied to the terminal 1011 of the block 161. By the connection as described above, the circuit blocks 101, 102, . . ., 112 correspond to the notes of the keys C7, B6, A#6, . . ., C#6, with each of the input terminals 1011 having a frequency in the four-foot group and each of the output terminals 1016 having a frequency in the eight-foot group. Similarly, the blocks 113, 114, . . ., 124 correspond to the notes of the keys C6, . . ., C#3, the blocks 149, 150, . . ., 160 to the notes of the keys C3, . . ., C#2, and the block 161 to the note of the key C2 respectively, with the signal of the input terminal 1011 of each block having a frequency in the four-foot group and that of the output terminal 1016 having a frequency in the eight-foot group. In each of the blocks 101, 102, . . ., 161, the input terminal 1011 is connected to the gate of the transistor Q5 which is part of a first NAND gate including the transistors Q3 to Q5, while the output terminal 1016 is connected to the gate of the transistor Q8 which is part of a second NAND gate including the transistors Q6 to Q8.

Subsequent to the foregoing description related to the tone source signal frequency dividing section, the functions of the keyboard scanning section will be described hereinbelow.

The source signal applied to the terminal 1 is divided to a frequency easy to handle by the $\frac{1}{4}$ frequency divider 3 and is further supplied to the $\frac{1}{2}$ frequency dividers 4 and 5. The outputs from the frequency dividers 3, 4 and 5 are applied to the three bit decoder 9 for developing eight different progressive pulses therefrom. The first output from the decoder 9 is coupled to the terminal 1013 of each of the blocks 101, 113, 125, 137 and 149 of the C note system and to the terminal 1013 of each of the blocks 109, 133 and 157 of the E note system for driving the transistor Q2 of each of these blocks. The transistor Q2 together with the transistor Q1 constitutes a transfer gate, and when; the transistors Q1 and Q2 are both turned ON, the signal applied to terminal 1017 is transmitted to the gates of the transistors Q4 and Q7. When either of the transistors Q1 or Q2 is turned off, the gate potentials of the transistors Q1 and Q2 are retained by the gate capacitors Cs1 and Cs2. On the other hand, the second output from the decoder 9 is coupled to the terminals; 1013 of the three blocks 110, 134 and 158 of the D# note system of all the blocks in the B note system. Since subsequent connections are in a manner similar to that described above, description thereof is omitted for brevity. Meanwhile, the output from the $\frac{1}{2}$ frequency divider 5 is further supplied to the three series-connected $\frac{1}{2}$ frequency dividers 6, 7 and 8, the outputs of which are applied to the three bit decoder for developing eight different progressive pulses from the decoder 10, whereupon the output progressive pulses from the decoder 9 is successively shifted from one to the next. The eight outputs from the decoder 10 are fed to respective columns of the keyboard matrix 12, and are simultaneously fed to the terminals 1012 of the blocks 101, 102, . . ., 161. More specifically, the first output from the decoder 10 is fed to the blocks 101 to 108, the second output to the blocks 109 to 112 and also to the blocks 121 to 124, the third output to the blocks 113 to 120, the fourth output to the blocks 125 to 132, the fifth output to the blocks 133 to 136 and to the blocks 145 to 148, the sixth output to the blocks 137 to 144, the seventh output to the blocks 149 to 156, and the eighth output to the blocks 157 to 161, thus driving the transistor Q1 forming part of the transfer gate through respective terminals 1012. On the other hand, the rows of the keyboard matrix 12 is connected to the input terminals 1017 for the blocks 101 to 161, with the first row being coupled to the blocks to which the first output of decoder 9 is connected i.e., to the blocks 101, 113, 125, 137, 149, 109 and 133 and also to the block 157, while the second to the eighth rows are connected to the terminals 1017 of the blocks to which the corresponding second to eighth outputs of the decoder 9 are coupled.

Still referring to FIGS. 1 and 2, the functions upon depression of the keys of the keyboard are described hereinbelow.

On the assumption that the key B4 of the keyboard is depressed, the fourth output from the decoder 10 is connected through a diode to the second row of the keyboard matrix. When the output progressive pulses of the decoder 10 are developed at the fourth output, i.e., when the fourth output is at high level, the terminals 1012 of the blocks 125 to 132 are rendered high, thus the transistors Q1 for those blocks are turned ON. Meanwhile, the second row for the keyboard matrix is rendered "high" through the switch Ks, and thus the terminals 1017 for the blocks 102, 114, 126, 138, 150, 110, and 134 and also for the block 158 are brought to a "high" state. Under this condition, the eight outputs of the decoder 9 are successively rendered "high", and only when the second output is brought to a "high" state, the terminals 1013 for the blocks 102, 114, 126, 138, 150, 110, 134 and 158 are rendered "high". Consequently, only the block 126 has both the transistors Q1 and Q2 turned ON. Therefore the information on the terminal 1017 of block 126, i.e., the "high" state is read into the gates of the transistors Q4 and Q7 for charging the capacitors Cs1 and Cs2 to a "high" state. Note here that the capacitors Cs1 and Cs2 are the gate capacitance formed between the gates of the MOS transistors Q4 and Q7 and a substrate (not shown). When the gate of the transistor Q4 is rendered "high", the other input to the first NAND gate constituted by the transistors Q3, Q4 and Q5, i.e., the gate signal applied to transistor Q5 is inverted and applied to, the output terminal 1015. In other words, the input signal applied to the ½ frequency divider 1010 is inverted, fed to the resistor R11 and applied to the output terminal 1015. Similarly, by bringing the gate of the transistor Q7 to a "high" state, the output signal of the ½ frequency divider 1010 is inverted by the second NAND gate including the transistors Q6, Q7 and Q8, fed to the resistor R12, and applied to the output terminal 1014. The outputs from the output terminals 1014 and 1015 are arranged into group of six notes (seven notes at bass tone side of the minimum octave only) of the same octave and coupled in this example, to terminals $t_{11}$ and $t_9$ of the terminal group 13. The signals from the terminals $t_{11}$ and $t_9$ are developed as the output of the musical instrument from speakers (not shown) through the tone filters and amplifiers (neither shown). More specifically, the terminal $t_{11}$ is the eight-foot group output of the keys C5 to G4, while the terminal $t_9$ is the four-foot group output of the keys C5 to G4, and these outputs are resistance mixed.

In the foregoing, the case in which the key B4 is depressed and the block 126 which corresponds to the key B4 is scanned was described. Thereafter the subsequent blocks are scanned successively. During this period, the transistors Q1 and Q2 of the block 126 are never turned ON simultaneously as is clear from the earlier description, and accordingly, the signal at the terminal 1017 is not transmitted to the gates of the transistors Q4 and Q7. In other words, the gate potentials of the transistors Q4 and Q7 remain in the same state as when the block was scanned due to the charge retained in the capacitors Cs1 and Cs2. Although a certain degree of voltage drop is inevitable due to leakage current and the like in the drain junction of the transistor Q2, MOS transistors manufactured through ordinary processes are capable of retaining a "high" level for approximately 10 m sec. without any particular addition to the capacitances the capacitors Cs1 and Cs2. Accordingly, if each of the blocks is scanned in a cycle shorter than the above retaining period, the information of the actuation of the keys is dynamically retained in the blocks. In the embodiment of FIGS. 1 and 2, since the input signal of approximately 2 MHz applied to the terminal 1 is divided by ¼ in the ¼ frequency divider 3 and further to 1/32 in the series-connected ½ frequency dividers 4, 5, 6, 7 and 8, the repetition frequency for scanning the blocks is about 15.6 KHz, with a scanning period of approximately 64 μsec. This is sufficiently shorter than the above "dynamic" retaining period, thus presenting no problems in actual use. Additionally, by setting the repetition frequency of the scanning signal outside of the audio frequency range or outside of range of tones employed for the electronic organs components of the repetition frequency may be removed by filters and adverse effects upon the tones by variation of the gate output amplitude due to charging and discharging of the holding charge can be eliminated. Upon release of the depressed key, the charge accumulated in the capacitors Cs1 and Cs2 is discharged through one of the resistors R1 to R8 of the group of discharge resistors 24 at the immediately subsequent scanning of the block 126; and the gates of the transistors Q4 and Q7 are returned to a "low" level.

Although the foregoing description is mainly directed to the case in which one of the keys is depressed, it is readily understood from FIGS. 1 and 2 that even when two or more keys are depressed simultaneously, the storage of information on the actuation of the keys and the opening and closing of the notes is effected independently for each of the keys in a manner similar to that of key B4 as described earlier.

Note, although the gate capacitances of the MOS transistors are stated as sufficiently large for the capacitors Cs1 and Cs2 without the necessity for any additional capacitance in the foregoing embodiment, on the contrary, the circuit may be so modified as to employ capacitances of considerably larger values for the capacitors Cs1 and Cs2 to increase the discharge time constant determined by the group of discharge resistors 24 for providing a continuous attenuation of the tone, i.e., a sustaining function. In the above case, discharge through the group of discharge resistors 24 takes place only during the period in which the particular block is being scanned, and in the structure of FIG. 1, for example, the duty ratio is 1/64. Accordingly, the above discharge time constant is prolonged by a factor of 64, and thus the values for the capacitors Cs1 and Cs2 may be correspondly reduced by that extent. The sustaining time may be controlled by associated variation of each of the resistors R1 to R8 in the resistor group 24, enabling an increased degree of free control, although gang-volume controls or the like may be required. If the group of resistors 24 of the foregoing embodiment is replaced by a group of variable impedance elements whose impedances are varied by a gate voltage or the like for indirect control of the impedances through variation of voltages, currents, etc., applied to control terminals such as gates, the number of control terminals can be conveniently decreased for formation into LSI and the like. The arrangement in the foregoing embodiment may be further modified to employ one discharge impedance element for change-over use, taking note of the fact that the discharge current of the accumulated charge flows through only one of the elements of the resistor group 24 at any moment while the other seven elements not being used. An additional circuit which may be employed in the above case is shown in FIG. 3.

Referring to FIG. 3, the additional circuit 15 represented by the portion surrounded by the dashed line is inserted between the decoder 9 and the keyboard switch block 12 of FIG. 1, and includes transistors Q11, Q12, Q13, Q14, Q15, Q16, Q17 and Q18 for change-over whose drains are connected to the respective numbers 1 to 8 of the abscissa for the keyboard matrix 12 and whose sources are connected in common with each other an further coupled to a discharge variable impedance element 16. The impedance element 16 is provided with a control terminal 17 for controlling the characteristics of the impedance element 16 such as the sustaining time and the configuration of the envelope. In the above arrangement, the transistor Q11, for example, is turned ON when the first output terminal of the decoder 9 is rendered "high", this time period corresponding to the time period when the circuit blocks 101, 113, 125, 137, 149, 109, 133 and 157 are scanned, and consequently to the time at which the resistor R1 of the group of discharge resistors 24 of FIG. 1 is rendered effective as a discharge element. The circuit construction as described above is advantageous because only one discharge element is sufficient for the purpose therefore deviation of the sustaining time due to differences in the characteristics of a plurality of discharge elements employed is eliminated, while not only the sustaining time, but the configuration of the envelope can be readily controlled by altering voltage and current discharge characteristics of the variable impedance element 16.

The present inventors have proposed various variable impedance elements for employment in the circuit arrangement as described above or for similar purposes, for example, in Japanese Patent Application No. 120856/1974 entitled "Variable impedance element" (filed Oct. 18, 1974 and laid open to the public on Apr. 21, 1976, Publication No. 46886/1976), Japanese Patent Application No. 100846/1975 entitled "Variable impedance element" (filed Aug. 19, 1975 and laid open to the public on Feb. 23, 1977, Publication No. 24477/1977), Japanese Patent Application No. 106750/1975 entitled "MOS type semi-conductor device and method of production thereof" (filed Sep. 2, 1975 and laid open to the public on Mar. 7, 1977, Publication No. 30183/1977), and also in U.S. Patent application Ser. No. 621,839 entitled "MOS type semi-conductor device" (filed Oct. 14, 1975 with priority claimed based upon the above described Japanese Patent Applications). Accordingly, reference may be made thereto for details of such variable impedance elements. Needless to say, however, variable impedance elements other than those disclosed in the above Patent Applications may be employed for the circuit arrangement of FIG. 3.

As is understood from the foregoing description, the first NAND gate including the transistors Q3, Q4 and Q5 and the second NAND gate including the transistors Q6, Q7 and Q8 should be analog type gates for providing the sustaining function through gradual discharge of the electrical charge accumulated in the capacitors Cs1 and Cs2 (FIG. 2). By setting the threshold voltage value and the mutual conductance value of the transistors Q3, Q4 and Q5 approximately equal to each other, the first NAND gate including the transistors Q3 to Q5 form an analog gate suitable for the purpose. The values of the transistors Q6 and Q8 of the second NAND gate may be similarly set.

Additionally, in the embodiment of FIGS. 1, 2 and 3, since the progressive pulses developed at the output terminals 1, 2, 3, 4, 5, 6, 7 and 8 of the decoder 9 are arranged continguously on time axis, malfunctions may result, if there exists any time lag due to propagation delays in the frequency dividers 3, 4, 5, 6, 7 and 8, the wiring arrangement in the keyboard matrix 12, or the like. However, this inconvenience may be readily eliminated by making the decoder 9 into a four bit decoder so as to generate the outputs 1, 2, 3, 4, 5, 6, 7 and 8 every other output of the sixteen decoder outputs.

Referring now to FIGS. 4 and 5, there is shown in FIG. 4 a first modification of the tone generator and keying sections of FIGS. 1 to 3, while in FIG. 5, one example of the circuit arrangement of reset blocks 201, 202, 203, . . . , 261 of FIG. 4 is shown. In this modification, the frequency dividers 3, 4 and 5 in FIG. 1 are replaced by a 1/16 frequency divider 18, while the decoder 9 described as employed in the circuit of FIG. 1 is dispensed with.

In FIG. 4, the 1/16 frequency divider 18 for dividing the signal from the input terminal 1 may be formed by a series connection of four stages of ½ frequency dividers. The reset blocks 201, 202, 203, . . . , 261 correspond to the respective blocks 101, 102, 103, . . . , 161 of FIG. 1. Meanwhile, the transistor Q2 in the circuit arrangement for each of the blocks 101 to 161 of FIG. 2 is modified so as to be a short circuit in the corresponding circuit arrangement of FIG. 5.

Subsequently, the functions of the circuits of FIGS. 4 and 5 will be described hereinbelow.

The keyboard switch block 12 is scanned in exactly the same manner as in FIG. 1, and signals corresponding to the ON and OFF states of the keys are supplied to the circuit blocks 201, 202, 203, . . . , 261. In FIG. 4, since the decoder 9 is dispensed with, the blocks 201, 202, 203, . . . , 261 are not successively scanned one by one as in the blocks 101, 102, 103, . . . , 161 of FIG. 1, but the blocks 201, 202, . . . , 208 are simultaneously scanned according to the scanning of the output of the decoder 10. Subsequently the blocks 209 to 212 and 221 to 224, the blocks 213 to 220 and 225 to 232, the blocks 233 to 236 and 225 to 258, the blocks 237 to 244 and 249 to 256, and the blocks 257 to 261 are sequentially scanned group by group.

In FIG. 5 showing construction of each of the blocks 201, 202, 203, . . . , 261, the transistor Q2, i.e., the gate to be opened or closed by the output of the decoder 9 of FIG. 1 is short-circuited. Accordingly, the signal applied to the terminal 1017 is transmitted to the two NAND gates composed of the transistors Q4 and Q7 all through the period in which a "high" level is applied to the terminal 1012, therefore the transistors Q1 for the blocks 201 to 208 are simultaneously turned ON as described above. Subsequently, the transistors Q1 for the eight or nine blocks in the other groups of blocks are turned ON at the same time in a manner similar to that above.

Except that a plurality of the blocks are simultaneously scanned in the above described manner, other functions of the arrangement of FIG. 4 are similar to those in FIG. 1, and therefore, detailed description thereof is omitted for brevity.

Note that the variations or modifications of the circuit arrangement described with reference to FIGS. 1 and 2 are generally applicable to the arrangement of FIGS. 4 and 5, although the construction which employs one discharge element sequentially switched over for a sustaining function as described with reference to FIG. 3 can not be applied to the circuit of FIG. 4.

Note also that in the foregoing embodiment, although the description is mainly made with reference to a one stage keyboard having sixty one keys, the concept of the present invention is not limited to application to a keyboard of the above described type alone, but may readily be applied to keyboards of other than sixty one keys or to various other keyboards including two stage keyboards, pedal keyboards and the like.

Note further that the embodiments of FIGS. 1 to 5 are particularly suitable for the formation into LSI. More specifically, in the case where the circuit is provided wih terminals 1, 2 and 13, and the sixteen terminals of the total row terminals and column terminals of the keyboard matrix 12, together with a sustaining function, only one or two control terminals need external connections, thus constituting an LSI with forty to forty two pins including the power source. Similarly, if the decoder 10 is to be provided outside the LSI package, the eight terminals for the columns of the matrix 12 may be replaced by three terminals for the outputs of ½ frequency dividers 6, 7 and 8.

In the foregoing embodiments, although capacitor is employed for storing the information of the actuation of the keys, a further modification of the tone generator and keying sections of the electronic organ of FIG. 1 will be described hereinbelow with reference to FIGS. 6 to 9, in which the information of the actuation of the keys is retained in a latch circuit mentioned later.

Reference is now made to FIG. 6 showing a second modification of the tone generator and keying sections of FIG. 1, and also to FIGS. 7, 8 and 9 showing examples of the construction of blocks 21 to 23, 301 to 361, and 371 to 382 employed in the arrangement of FIG. 1.

In the modification shown in FIG. 6, the ¼ frequency divider 3 and ½ frequency divider 4 described as employed in the circuits of FIG. 1 are replaced by a 1/16 frequency divider 18, the decoder 9 is also replaced by a two bit decoder 19 and the blocks 20 to 23 and 371 to 382 described later are further included, although the functions of the decoder 10, the top octave divider 11, the keyboard matrix 12, the output terminal group 13, and the keyboard switch group 14 are similar to those in the embodiment of FIG. 1. In FIG. 6, clock pulse signals having a frequency of approximately 4 MHz, for example, are applied to the input terminal 1 from a clock source (not shown), while the reset signals for the frequency dividers 18, 5, 6, 7 and 8 are applied through the reset signal input terminal 2. The 1/16 frequency divider 18 may be formed, for example, by a series-connection of four ½ frequency dividers. The frequency dividers 5, 6, 7 and 8 each for ½ frequency division are constructed to subsequently subject the output of the 1/16 divider 18 to successive ½ frequency division. The two bit decoder 19 decodes the outputs of the 1/16 frequency divider 18 and ½ frequency divider 5 so as to produce four progressive pulses. Each of the circuit blocks 301, 302, 303, . . ., 361 generally comprises a ½ frequency divider 2019, an inverter 2010, NAND gates 2011, 2012, 2013 and 2014, AND gates 2015, 2016, 2017 and 2018, and resistors R1, R2, R3 and R4 arranged as shown in FIG. 8, and corresponds to one of the sixty-one.

The functions of the tone generator and keying circuits of FIG. 6 will now be described hereinbelow.

Signals having twelve different frequencies in which the two-foot group of fundamental frequencies of the twelve notes of the keys C7 to C#6 range from approximately 8,372 Hz to 4,186 Hz are produced by the top actave divider 11 from the source signal applied to input terminal 1 by successive division by a ratio of about $\sqrt[12]{2}$. These signals are supplied to terminals 2002 of the circuit blocks 301, 302, 303, . . ., 312. The signal thus applied to the terminal 2002 is divided by half by the ½ frequency divider 2019 and is applied to the terminals 2006 for being fed to the input terminal 2002 of the subsequent block and also applied to the terminal 2001 for being fed to the input terminal 2005 of the previous block. The terminals 2005 and 2006 of the block 349 are respectively connected to the terminals 2001 and 2002 of the block 361. By these connections, the blocks 301, 302, 303, . . ., 312 correspond to the notes of the keys C7, B6, A#6, . . ., C#6, with the signal at each of the input terminals being of the two-foot group frequency, the signal at each of the output terminals 2006 being of the four-foot group frequency, and the signal at each of the terminals 2005 being of the eight-foot group frequency. Similarly, the blocks 313, 314, 315, . . ., 324 correspond to the notes of the keys C6, . . ., C#5, the blocks 349, 350, 351, . . ., 360 to the notes of the keys C3, . . ., C#2, and the block 361 to the note of the key C2 respectively. The signal of the input terminal 2002 of each block has the frequency of the two-foot group, the signal at the output terminal 2006 has the frequency of the four-foot group, and the signal at the terminal 2005, has the frequency of eight-foot group. In each of the blocks 301, 302, 303, . . ., 361, the input terminal 2002 is connected to one input of the AND gate 2015, while the output terinal 2001 is connected to the output of the divider 2019. Similarly, the terminal 2006 is connected to the output of the divider 2019, and the terminal 2005 to one output of the AND gate 2018.

Subsequent to the foregoing description related to the tone source signal frequency division section, functions of the keyboard scanning section will be described hereinbelow.

The source signal applied to the terminal 1 is divided into a frequency easy to handle by the 1/16 frequency divider 18 and fed to the ½ frequency divider 5. The outputs from the frequency dividers 18 and 5 are applied to the two bit decoder 19 to produce four different progressive pulses from the decoder 19. The third of the outputs from the decoder 19, is coupled to one terminal of each of the eight AND gates in the block 20 to be used as strobe pulses.

On the other hand, the output from the ½ frequency divider 5 is further fed to the three ½ frequency dividers 6, 7 and 8. The outputs from the dividers 6, 7 and 8 are applied to the three bit decoder 10 which in turn produces eight different progressive pulses as an output. The output progressive pulses of the decoder 10 are successively shifted from one to the next. The eight outputs from the decoder 10 form the ordinate of the keyboard matrix 12, and are simultaneously fed to the other input terminals of each of the eight AND gates in the block 20 for strobing thereat to generate narrow pulses which are supplied to terminals 2003 of the blocks 301, 302, 303, . . ., 361. More specifically, the outputs of the decoder 10 are fed to the blocks 301, 302, 303, . . ., 361 respectively through the AND gates in the block 20, and drive NAND gates 2011 and 2012 which are employed as strobe gates through respective terminals 2003. On the other hand, the abscissa of the keyboard matrix 12 are connected to input terminals 2004 of the blocks 301, 302, 303, . . ., 361 in a manner similar to the embodiment of FIG. 1, while the NAND gates 2013 and 2014 in each of the blocks 301 to 361 constitute a latch circuit for storing and retaining the information of the actuation of the corresponding key of the sixty-one keys.

FIG. 7 shows one example of the blocks 21 to 23 which retain the state of the note change-over switches SW1 to SW3 (FIG. 6) during the keyboard scanning. The circuit includes an inverter 4010, and NAND gates 4011, 4012, 4013 and 4014. The input terminals 4001 of the blocks 21, 22 and 23 are respectively connected to the sixth, seventh and eighth rows of the keyboard matrix 12. A signal formed by narrowing the pulse width of the output from the eight ordinate of the keyboard matrix 12 in the eighth NAND gate of block 20 is supplied to the other input terminal 4002 of each block 21 to 23. The output of the latch circuit formed of NAND gates 4013 and 4014 is applied to terminal 4003.

Subsequently, functions of the blocks 21 to 23 will be described hereinbelow.

The switches SW1 and SW2 are tone colour-select and change-over switches for the four-foot group and the eight-foot group respectively. The switch SW3 is an ON.OFF change-over switch for the four-foot group. Table 1 shows the relation between the opened and closed state of each of the switches SW1 to SW3 and the notes.

Table 1

| Mode switch | Opened | Closed |
|---|---|---|
| SW1 | Four-foot group tone source is of rectangular wave (S = low) | Four-foot group tone source is of stair case wave (S = high) |
| SW2 | Eight-foot group tone source is of rectangular wave (T = low) | Eight-foot group tone source is of stair-case wave (T = high) |
| SW3 | Four-foot group has no output (U = low) | Four-foot group has output (U = high) |

On the assumption that the switch SW1 is kept closed, when the eighth output of the decoder 10 is "high", a "high", input is impressed upon the input terminal 4001 of the block 21. Furthermore, when the third output of the decoder 19 is "high", the output of the AND gate at the right of the block 20 is rendered "high", with the terminal 4002 of the block 21 also being rendered "high", and thus the information at the terminal 4001 is transmitted to the latch circuit including NAND gates 4013 and 4014 to be read into the latter. When the output "high" from the decoder 19 is transferred from the third output to the fourth output, the terminal 4002 is rendered "low", and the gates 4011 and 4012 are closed for storing and retaining the immediately previous information in the latch circuits 4013 and 4014 which is fed to the blocks 301, 302, 303, . . ., 361 as output S. In this case, if the opened or closed state of the switch SW1 is changed, the variations taking place immediately thereafter when the switch SW1 is scanned is read into the latch circuits 4013 and 4014 to vary the output S. Therefore, although there exists a certain time lag for this change over, this time lag is less than about 64 μsec. in the above modification in which the source oscillation frequency is approximately 4 MHz, thus presenting no particular problems in actual use as a musical instrument.

Although the functions of the blocks 22 and 23 are exactly the same as the block 21 and description thereof is omitted by brevity, the outputs from the blocks 22 and 23 are supplied to the blocks 301 to 361 as the signals T and U (Table 1), respectively.

Referring now to FIG. 9, each of the blocks 371 to 382 includes a ½ frequency divider 3003 which divides the frequency of the signal at the terminal 3002 by ½ for output from the terminal 3001. This divider 3003 is reset by the reset signal applied to the input terminal 2 (FIG. 6).

Subsequently, the functions upon depression of the keys are described hereinbelow.

On the assumption that a given key, for example the key B4, is depressed, the fourth output from the decoder 10 is coupled to the second row of the matrix 12 through the diode D. Accordingly, when the output progressive pulses of the decoder 10 appear in the forth output, i.e., when the fourth output is rendered a "high" level, the second row of the keyboard matrix 12 is rendered "high" through the diode D connected in series with the keyboard switch Ks which corresponds to the key B4, and thus the terminal 2004 of each of the blocks 302, 326, 338, 350, 310, 334 and 358 is rendered "high". In the above state, when the third output from the decoder 19 is rendered "high", the fourth output from the left of the block 20 is also rendered "high", thus applying a "high" signal to the terminal 2003 of each of the blocks 325 to 332. Accordingly, the signals from the terminals 2004 of the blocks 325 to 332 are respectively transmitted to the corresponding latch circuits 2013 and 2014. When attention is directed to the block 326, since the terminal 2003 is impressed with a "high" signal, the gates 2011 and 2012 are opened when the terminal 2004 is rendered "high", and the state at the terminal 2004 is supplied to the latch circuit including the NAND gates 2013 and 2014, thus applying a "high" to one input of each of the AND gates 2015 to 2018. When the terminal 2003 is rendered "low", the gates 2011 and 2012 are closed, and the immediately preceding state is retained by the latch circuits 2013 and 2014, thus the signal level supplied to the AND gates 2015 and 2018 is not altered.

In this state, if the signals S, T and U are all assumed to be "high" for simplification, the rectangular waves at the input terminal 2002 appear at the output of the AND gate 2015, while the output of the frequency divider 2019, i.e., the rectangular waves also applied to the terminal 2006 appear at the output of the AND gate 2016. Similarly, the signal at the terminal 2006 and that at the terminal 2005 (the output of the frequency divider at the subsequent stage) appear at the outputs of the AND gates 2017 and 2018, respectively. The output signal of the AND gate 2015 and that of the AND gate 2016 are mixed through resistors R1 and R2 to be developed as an output from the terminal 2007.

FIG. 10 shows the state of the signal output from terminal 2007 assuming that R1 is equal to 2R2. By mixing rectangular waves of the desired repeating frequency with rectangular waves having twice the desired repeating frequency stair-case waves having the desired repeating frequency can be obtained thereby imparting a richness to the tone color. If the output S is "low", the gate 2015 is closed, and the output of the gate 2016 becomes the output from the terminal 2007. In this case the output signal is a rectangular wave, thus presenting an altered tone color. Therefore, depending on whether the signal S is high or low, the signal at the terminal 2007, i.e. the tone color of the four-foot group, can be altered. Meanwhile, when the signal U is "low", the gates 2015 and 2016 are both closed, and consequently, tones of the four-foot group and the like are not developed as an output. The above state is generally similar to that in the eight-foot group which develops an output from the terminal 2008 through mixing of the outputs from the AND gates 2017 and 2018 by resistors R3 and R4. In the eight-foot group, the signal S is replaced by the signal T by which change-over between rectangular waves and stepped waves is effected. Note that since the eight-foot group corresponds to the fundamental repeating frequency of the notes, signal corresponding to the signal U of the four-foot group is not employed.

The above description is related to the case wherein the key B4 is closed. When the key B4 is opened, upon scanning of the key B4 immediately thereafter, i.e. when a "high" output is developed at the fourth output of the decoder 10 and a "high" output appears at the third output of the decoder 19, the contents of the latch circuits 2013 and 2014 are rewritten. In this case, although a certain time lag may be present, this delay is less than about 64 μsec. in a manner similar to the cases of the switches SW1 to SW3 earlier mentioned, and presents no particular problem in actual use.

Note that in the foregoing, although the description is directed to the time period when the key B4 is depressed and the key B4 is scanned by the fourth output of the decoder 10, the functions are exactly the same for the other keys, and in the case where two or more keys are depressed simultaneously notes corresponding to the actuation of the respective keys are independently developed as outputs.

Note also that the arrangement as described above may be so modified as to directly alter the tone source waveforms by utilizing the output of the note change-over switches.

Needless to say, although the foregoing embodiment is described with reference to a one stage keyboard of sixty-one keys, the scope of the present invention is not limited to the above, but may be widely applied to a case other than sixty-one keys or to keyboards of two or more stages or those including pedal keyboards.

According to the arrangement in the foregoing embodiment, all parts up to the tone filter are constituted by a one chip LSI having forty terminals in total, i.e., the input terminals 1 and 2, the group of output terminals 13, eight terminals each for the rows and columns of the keyboard matrix 12, and two terminals for the power supply. In the above arrangement, if the decoder 10 is disposed outside of the LSI, connections of lines from the LSI to the columns of the matrix 12 can be reduced to three outputs for the frequency dividers 6 to 8, with a consequent reduction in the number of leads required to that extent. It is possible to incorporate the oscillation circuit within the LSI, to increase the number of keys, and to alter or increase the control functions such as increasing the kinds of note change overs or the like. Furthermore, it is possible to employ two or more LSIs as in the embodiment of FIG. 1 in the same electronic organ so as to have one LSI in the upper keyboard, one in the lower keyboard, etc. In this case, it is preferable to reset all the frequency dividers of all the LSIs by reset signals at the time when the power supply is turned ON or when the first key is actuated.

Note that in the foregoing embodiment, the input signal to the note frequency divider and the keyboard scanning signal are obtained from the same signal source, but this arrangement may be modified to employ an independent signal source for each.

As is seen from the foregoing description, according to the embodiment of FIG. 6, the latch circuits corresponding to the plurality of keys are provided in the ratio of 1:1 for storing and retaining the information of the actuation of the keys in these latch circuits. Thus not only is the circuit construction simplified, but this construction is advantageous from the view point of the degree of integration in the LSI formation.

Furthermore, when the tone color and change-over switch group is incorporated in the same keyboard matrix as the keyboard as in the embodiment of FIG. 6 and the scanning of the tone color and change-over switches is effected within the same scanning routine as in the keyboard scanning, it is possible to prevent production of unclear tones due to leakage of unnecessary signals by tone variations or by cutting of the four foot system tones when not in use.

The remaining portions of this matrix may be used in exactly the same manner as in the arrangement of the embodiment of FIG. 1.

Note that the discharge resistor group 24 is not provided with a sustaining function in the foregoing embodiment, but merely works to discharge the electrical charges accumulated in the stray capacitance or the like of the wiring.

Reference is made to FIG. 11 showing a further modification of the tone generator and keying sections, and to FIG. 12 showing one example of the construction of blocks 401, 402, 403, . . ., 488 employed in the arrangement of FIG. 11. In this modification, by dynamically memorizing and retaining the information of the depression of the keys arranged in the matrix, and envelope information and the like in a capacitor of comparatively small capacitance, a musical instrument in which the tone signal amplitude corresponds to the depression speed of the keys, and which has pianolike envelope and an extremely simple arrangement particularly suited to integral circuit formation is advantageously achieved. Note that in the arrangement of FIG. 11 the constructions and functions of the blocks 5, 6, 7, 8, 11 and 19 are generally similar to those in FIG. 6, and therefore, description thereof is omitted for brevity.

In the modification of FIG. 11, a clock source signal having a frequency of approximately 2 MHz is applied to the input terminal 1, while a reset signal for the frequency dividers is applied through the input terminal 2. Twelve outputs from the top octave divider 11 are each supplied to the terminal 5004 (FIG. 12) of each of the circuit blocks 401, 402, 403, . . ., 412. The signal thus applied to the terminal 5004 is subjected to ½ frequency division by the ½ frequency divider 5001 and output from the terminal 5005 for being further supplied to the input terminal 5004 of the subsequent block. By the connections as described above, the blocks 401, 402, 403, . . ., 412 correspond to the notes of the keys B7 to C#7, the blocks 413, 414, 415, . . ., 424 to the notes of the keys C7, B6, . . ., C#6, and similarly, the blocks 425, 426, 427, . . ., 488 to the notes of corresponding octaves. In each of the blocks 401 to 488, the input terminal 5004 is connected to the gate of the input transistor Q5 at one terminal of each of a first analog gate including MOS transistors Q3, Q4 and Q5. Similarly, the output of ½ frequency divider 5005 is connected to the gate of Q8 of the second analog gate including MOS transistors Q6, Q7 and Q8.

Subsequent to the foregoing description related to the tone source signal frequency division section, the keyboard scanning section in the arrangement of FIG. 11 will be described hereinbelow.

The source signal applied to the input terminal 1 is divided to a frequency readily dealt with in the ¼ frequency divider 3 and further supplied to the ½ frequency dividers 5 to 8 which are connected in series with each other. The outputs of the frequency dividers 5 to 8 into progressive pulses $P_0$, $P_1$, $P_2$, . . ., $P_7$ which do not overlap. These progressive pulses $P_0$ to $P_7$ are shown in FIG. 14 together with their levels. In other words, the progressive pulses $P_0$ to $P_7$ are normally of $-V_1$ volt, with the pulses ceiling voltage of OV, and are in the form of eight different repeating progressive pulses which do not overlap with each other.

The output progressive pulses $P_0$ to $P_7$ of the decoder 10 are supplied to the columns of the keyboard matrix 25 and simultaneously to one input terminal of each of the eight AND gates in the AND gate group 20. Note that the signals to the AND gate group 20 should preferably be pulses between $V_1$ and 0 in which the signals in FIG. 14 have been shifted in the positive direction by $V_1$, since in this case close agreement between the input at the other input terminal of the AND gate and this level is obtained. The keyboard matrix 25 has the outputs $P_0$ to $P_7$ of the decoder 10, having the waveforms as shown in FIG. 14, fed to its abscissas while the rows of the matrix 25 are grounded through respective variable impedance elements in the block 24. At the junctions or intersections of the row and columns of the matrix 25, keyboard contacts and their associated circuits as shown in the example of FIG. 13 are provided. The junction 26 between the column connected to the output $P_7$ of the decoder 10 and the row $R_0$ is illustrated in FIG. 13. Note that the other junctions marked by small circles in FIG. 11 are arranged in exactly the same manner as in the example of FIG. 13.

The functions of the junction circuits 26 will be described hereinbelow.

Keyboard switches SW11 and SW12 are each normally connected to terminals NC (normally ON) when the keys are not being depressed, thus charging the capacitor C1 to V1. When a player depresses, for example, the key for the musical scale note C1, the keyboard switch SW11 is opened at the terminal NC, the charge of the capacitor C1 begins to be discharged through the resistor $R_{101}$, and the potential difference across the capacitor C1 gradually decreases. Subsequently, when the contact of the keyboard switch SW11 is connected to its terminal NO (normally OFF) as the displacement of the key increases, the current arising from the charge of the capacitor C1 also flows to the base of the transistor Q11 where it is current amplified for charging a capacitor C2. Note that the current amplification may be replaced by a diode means if the capacitance ratio between the capacitors C1 and C2 is arranged to be sufficiently large.

In FIG. 13, if the forward voltage drop across the base and emitter of the transistor Q11 and the forward voltage for diodes D1 and D2 are neglected for simplication of description, the potential difference across the capacitor C2 is approximately equal to that across the capacitor C1 at the time when the common terminal of the keyboard switch SW11 is connected to the terminal No. Accordingly, when the output $P_7$ of the decoder 8 is $-V_1$, the potential at point X is a value between $-V_1$ and 0, and the faster the speed the keyboard switch is depressed, i.e., the shorter the time period between the departure of the common terminal of the keyboard switch SW11 from the terminal NC and the connection of the common terminal to the terminal NO, the closer to 0 is the potential value at the point X.

When progressive pulses appear at the output $P_7$ of the decoder 8, i.e., when that column is rendered 0, the potential at the point X is raised in the position direction by $V_1$, reaching a value between 0 and $V_1$. At this moment, the column corresponding to the junctions connected to the row $R_0$ all have a potential of $-V_1$, and therefore, all the X points at these junctions are between $-V_1$ and 0. Accordingly, the potential at the junction where the ordinate is 0, i.e., the potential at the point X of the junction circuit 26 corresponding to the musical scale note C1 appears at the row $R_0$ through the diode D1. The row $R_0$ is connected to the terminal 5002 of each of the blocks 401, 413, 425, 437, 449, 461, 473 and 485, while the column of the matrix 25 are applied to respective AND gates 20, whereat and AND operation taken with respect to the strobe signal fed from the decoder 19 through the AND gate associated therewith, and the sigal from AND gates 20 is subsequently fed to the terminal 5003 of each of the blocks 401 to 488 in the form of progressive pulses which begin later than the output of the decoder 25, and which end sooner than the same output of the decoder 25, with low level of 0 and high level of $V_1$. Meanwhile, the output of the column, i.e, the output $P_7$ of the decoder 8 in the form of pulse $SP_7$ as shown in FIG. 15 is supplied to the terminal 5003 of each of the blocks 485, 486, 487 and 488 and the transistor Q1 of each of the blocks is turned ON. Accordingly, the potential across the capacitor C2 of the junction 26 is transmitted to the capacitors Cs1 and Cs2 of the gates of the transistors Q4 and Q7 of the block 485. These transistors Q4 and Q7 are turned ON by the potential transmitted to their gates in the above described manner. The output rectangular waves of the transistors Q5 and Q8 is transmitted to the gates of the transistors Q9 and Q10. In this case, since the potential is dynamically retained in the capacitors Cs1 and Cs2 even after the progessive pulses of the decoder 10 have moved to other portions and the transistor Q1 is turned OFF, the transistors Q4 and Q7 are maintained in the ON state. The transistors Q9 and Q10 which form a source follower act as an impedance converter to prevent cross modulation by other tones. By the functions as described above, rectangular waves repeating at the fundamental frequency, and rectangular waves one octave higher are obtained, and are mixed by resistors R11 and R12 at a predetermined mixing ratio for being output from the output terminal 5006.

On the other hand, when the potential of the output $P_7$ of the decoder 10 is 0, the charge of the capacitor C2 of junction circuit 26 is discharged through one element of the group of variable impedance elements which are connected to respective rows of the matrix 25, and thus the potential at the point X gradually decreases. The discharge as described above takes place whenever the column of the matrix 25 is rendered 0, and at each such time the potential of the capacitors Cs1 and Cs2 of the block 485 also decreases little by little. Correspondingly the ON resistance of the transistors Q4 and Q7 gradually rises, while the amplitude of the note signal supplied to the gates of the transistors Q9 and Q10 gradually decreases for a so-called attenuating sound. keyboard switch SW11 is returned to the terminal NC and the capacitor C1 is again charged to be ready for subsequent depression of the key, while simultaneously the keyboard switch SW12 is grounded through the terminal NC. The opposite sides of the capacitor C2 become the same potential when the output terminal $P_7$ of the decoder 10 is 0. The capacitor C2 is thus discharged to render the potential of the terminal 5002 of the block 485, and consequently that of the capacities Cs1 and Cs2, to 0, thus the transistors Q4 and Q7 are turned OFF to erase the notes. If the grounding of the point X through the keyboard switch SW12 is eliminated, the tones remain even after releasing of the keyboard.

Although the foregoing description is mainly directed to the circuit corresponding to the key C1, the functions are same for the other notes. In short, the arrangement in the foregoing description is such that as the output of the decoder 10 is successively transferred from $P_0$ to $P_7$, the notes are sequentially scanned from octave to octave. During this period the analog amplitude information is memorized and retained in the capacitors Cs1 and Cs2 of each of the blocks 401 to 488, while the envelope control discharge element is provided one by one for the rows of the matrix 25 for time division use. The outputs from the blocks 401 to 406 are combined into one line and applied to the tone filter from the left-most terminal of the terminal group 13 to be imparted with a predetermined tone quality. Subsequently, six notes at a time are combined into one line in a manner similar to that described above and supplied to respective tone filters to be imparted with a quality tone at the corrsponding tone filter suited to that tone range, except for four notes at the right-most terminal.

It will be readily understodd from the foregoing description that although a power source B5 for level shifting is shown as provided in the block 26 of FIG. 13, such a power source is not actually required for each block 26, but one power source for each column of the matrix 25 sufficiently serves the purpose.

Note here that various types of elements, for example, the variable impedance elements or the variable impedance circuit disclosed in the earlier mentioned Patent Applications by the present inventors and described with reference to the numeral 16 of FIG. 3 may be employed for the combined variable elements of the block 24, in which case, attenuation characterics extremely close to that in pianos can be obtained. The block 24 may be formed upon the same chip as one of the other circuit portions except for the block 9 in FIG. 1 or upon a separate IC (integrated circuit) chip including only the block 24, or may be assembled from individual parts.

Note that the variable impedance elements, in the block 24 described as disposed one by one for the rows of the matrix 25 in the foregoing embodiment may be modified into a system which the blocks of the tone source both vertically and laterally as in the embodiment of FIG. 1, In this case, only one variable impedance element is required for use through successive change-over thereof, for example, a change-over element, although the discharge time for the capacitor C2 in this case is limited to the time period in which the discharge element is connected to the corresponding line. Additionally, since the input terminal 2 is the reset input terminal for resetting the frequency divider in the system and is required for phase alignment when two or more of the circuits as shown in FIG. 11 are simultaneously driven by the same clock, this terminal 2 may be dispensed with if not required.

In the embodiment of FIG. 11, portions excepting the matrix 25 of the keyboard block may be formed into an LSI having 40 to 42 pins, and such an arrangement is extremely effective for providing a compact size for the system as a whole, and also for reduction of cost. Furthermore, various variations or modifications are further possible, for example, forming the variable impedance device 24 upon a separate chip for varying the characteristics thereof according to the system construction, in which case the number of terminals of the main LSI is not changed.

Note that in the foregoing embodiment, although description is made with reference to the case of eighty-eight keys, i.e., the same number of keys as in pianos, the concept of the present invention is not limited in its application to the case of eighty-eight keys, but may be readily applied to a case with a different number of keys as well. In addition the matrix 25 having the proportions of a depth of 12 and a width of 8 in the described embodiment may be altered to any other proportions, for example, to 16×6. In this case, the decoder 10 must be a four bit decoder, but a LSI of forty to forty-two pins can still be formed even when this four bit decoder 10 and the top octave divider 11 have outside connections, although a decoder for supplying progressive pulses to the AND gate group 20 must be provided inside the LSI, thus further requiring a separate four bit decoder or an equivalent circuit, for example, a shift register.

Note that in the foregoing embodiment, the gate capacitors Cs1 and Cs2 of the MOS transistors are employed as electrical capacitors for memorizing and retaining the analog values, but the arrangement may be so modified as to utilize other circuit elements for memorizing and retaining the analog values in electrical capacitance, for example, the capacitance of transistors, wiring capacitance, parasitic capacitance or the like.

As is clear from the foregoing description, in the arrangement of FIG. 11, since information, for example analog amplitude or the like is dynamically memorizied and retained by a small capacitance such as the gate capacitance of the MOS transistors or the like, various functions as described below can be achieved in electronic musical instruments which employ the group of keyboard contacts arranged in an electrical matrix.

(1) The tone envelope can be freely controlled.
(2) A tone magnitude corresponding to the speed of key depression is available.
(3) Since the electrical charge discharging variable impedance elements for envelope control are simultaneously used for a plurality of keys, the number thereof may be smaller than the number of keys.
(4) Since the discharging of the electrical charge for the envelope control is effected intermittently, the capacity of the capacitance for charge accumulation may have a small value.
(5) The function of erasing the note from the key releasing information can be readily achieved.

Referring now to FIG. 16, there is shown a further modification of the keyboard junction marked with the small circles in the matrix 25 to FIG. 11 and the block 26 which is the circuit associated therewith. In this modification, the junction 26 is the intersection between the column connected to the output $P_7$ of the decoder 10 and the row $R_O$.

The functions of the junction 26 will be described hereinbelow with reference to FIG. 16, in which the voltage between the base and emitter of the transistor Q11 is not neglected, but is represented as $V_O$.

In FIG. 16, voltages for controlling the magnitude of the tones, the envelopes, the attenuation characteristics and the like are applied to the control terminals 911 and 912. The relation between the values of the control voltages impressed upon the terminal 911 and 912 and operational modes thereof is shown in Tables 2 and 3, in which the forward voltage drop of P-n junction represented by $V_D$ has a value of approximately 0.6 volt.

Table 2

| Voltage at terminal 911 | Operational mode |
|---|---|
| $-V_1$ | The tone magnitude varies according to the speed of depression of the key, while the tone envelope is attenuated from the initial stage of the key depression (piano mode) |
| $V_D$ | The tone magnitude does not vary according to the speed of depression of the key, and the tone envelope has a constant amplitude while the key is depressed (organ mode) |

Table 3

| voltage at terminal 912 | Operational mode |
|---|---|
| 0 | The tone disappears upon releasing of the depressed key |
| $V_1$ | The attenuating tone remains even after releasing of the depressed key |

Firstly, the functions in the state in which the teminal 911 is at $-V_1$ and the terminal 912 is at 0, i.e., in the state in which the damper pedal of the instrument is not depressed will be described hereinbelow.

When the keys are not depressed, the keyboard switches SW11 and SW12 are each connected to their respective terminals NC (normal ON), and therefore, the capacitor C1 is charged to $V_1-2V_D$ is the forward voltage drop of the P-n junction mentioned earlier, and $2V_D$ is the voltage drop in the series connection of diodes D4 and D5.

On the assumption that a player depresses the key for the note C1, the keyboard switch SW11 is opened at the terminal NC, and the charge in the capacitor C1 starts to be discharged through resistors R101 and R102 and the diode D3, with potential difference across the capacitor C1 gradually decreasing. As the displacement of the key increases, the contact of the keyboard switch SW11 is connected to the terminal NO (normal OFF). In the above case, when the column of the matrix connected to the output $P_7$ of the decoder 10 becomes $-V_1$, i.e., when that column is scanned, the discharge current of the capacitor C1 also flows into the base of the transistor Q11 to be subjected to current amplification thereat for charging the capacitor C2. Note that if the capacitance ratio of the two capacitors C1 and C2 is sufficiently large, current amplification is unnecessary, and the transistor Q11 may be replaced by a suitable diode. If the potential difference across the capacitor C1 at the moment when the contact of the keyboard switch SW11 is connected to the terminal NO is represented by $V_K$, which is a value between $V_1-2V_d$ and 0, the capacitor C2 is charged to a potential difference of $(V_K+2V_D)-V_D$, i.e., $V_K+V_D$.

On the supposition that the contact of the keyboard switch SW11 is connected to the side of the terminal NO during the period when the column of the matrix is 0, the transistor Q11 is not rendered conductive at that moment, but is turned ON after the column of the matrix, i.e., the right terminal of the capacitor C2 in FIG. 3 has reached $-V_1$ for charging this capacitor C2. In the above case, the delay in the charging function is seemingly equivalent to a slight delay in the speed of key depression, resulting in an error in the detected key depression speed. However if the source signal is 2 MHz as in the above embodiment, the error is approximately 4 μsec. at maximum, while in the actual performance of the instrument by a player, the time required between the departure of the contact of the keyboard switch SW11 from the terminal NC and the connection thereof to the terminal NO is approximately in the range of 0.1 msec. to 100 msec., thus presenting no particular problem in the actual use. When the output $P_7$ of the decorder 10 is $-V_1$, the potential at the X point is $V_K+V_D-V_1$, with $V_K$ being a value between $V_1-2V_D$ and 0. The point X consequently has a value between $-V_d$ and $-(V_1-V_D)$, and thus the higher the speed of the key depression, i.e., the shorter the time period between the departure of the movable contact of the keyboard switch SW11 from the terminal NC and the connection thereof to the terminal NO, the closer the value is to $-V_D$ side.

In the above state, when the progressive pulses are developed at the output $P_7$ of the decoder 10, i.e., when the column is 0, the potential at the point X is made more positive by $V_1$ to reach a value between $V_1-V_D$ and $V_D$. This row of the matrix and the column corresponding to other junctions connected to the row $R_0$ in the above case are all $-V_1$ at this moment, and therefore, the voltages at the points X of these junctions are all between $-V_D$ and $-(V_1-V_D)$. Accordingly, the potential at the junctions whereat the columns are 0, i.e., the potential at the point X of the junction 26 for the musical scale note C1 is subjected to voltage drop by $V_D$ through the diode D1, which appears at the row $R_0$ as a voltage in the range between $V_1-2V_D$ and $V_D$. The column to which attention is now directed, i.e. the output $P_7$ of the decoder 10, is a pulse SP6 as shown in FIG. 15, which is supplied to the terminals 5003 of the blocks 485, 486, 487 and 488 to turn ON the transistors Q1 in these blocks. Accordingly, the potential across the capacitor C2 of the block 26 drops by $V_D$ and is transmitted to the capacitors Cs1 and Cs2 of the gates and the like of the transistors Q4 and Q7 of the block 485. Since the function of the block 485 is the same in this case as in the arrangement of FIG. 13, description thereof is omitted for brevity.

The operation when the potential of the terminal 912 is rendered $V_1$, and the potential of the terminal 911 which is arranged in the junction 26 of the keyboard matrix 25 remains at $-V_1$, is described hereinbelow.

In the above case, the functions for the initial stage of the key depression and during the key depression are the same as those in the foregoing description. However, at the time when the key is released from depression, the electrical charge of the capacitor C1 is not discharged, since the diode D2 is biased in the reverse direction or cut off due to a small degree forward bias less than $V_D$, and the capacitor C2 is discharged primarily through the impedance element of the block 24 even after the depressed key is released. Accordingly, the tone does not disappear immediately, but continues while attenuating.

The operation when the potential of the terminal 911 is rendered $V_D$, i.e. the organ mode, will be described hereinbelow.

In the foregoing arrangement, while the keyboard switch SW11 is connected to the terminal NC, almost no potential difference is present across the capacitor C1, and accordingly, when the keyboard switch SW11 is connected to the terminal NO irrespective of the key depression speed, a 0 potential is supplied to the base of the transistor Q11, this same potential being supplied at all times while the key is kept depressed. Therefore, during the depression of the key, the potential $V_1-2V_D$ is kept impressed upon the gates of the transistors Q4 and Q5 of the block 185, without any variation in the magnitude of the tone. Since the functions after the releasing of the depressed key are the same as those in the case where the terminal 911 is maintained at $-V_1$, description thereof is omitted for brevity.

Note here that in the above description of the organ mode, although the potential at the control terminal 911 is $V_D$, the same effect can actually be obtained even when the potential is 0, and in the actual construction of the system, it is preferable to set the potential to 0 for simplification.

Note that in the organ mode also, the discharge of the charge in the capacitor C2 takes place through the impedance element of the block 24, but this presents no particular problem if the scanning repeating frequency of the matrix columns is arranged to be outside the audio frequency range or if the time constant for the attenuation (or equivalents) is made sufficiently longer than the above scanning repeating frequency.

Additionally, it will readily be understood that in the foregoing description, although the diodes D4, D5 and D6 are described as arranged in each of the circuits at the respective junctions of the keyboard matrix 25, such a set of diodes D4, D6 is not required at each of the junctions, but one set thereof in the keyboard matrix 25 of FIG. 11 sufficiently serves the purpose. In other words, the above arrangement can readily be effected by making the poing Y of FIG. 16 common to all circuits 26 of matrix 25.

Note further that in FIG. 16, although two resistors and one diode are employed in the discharge circuit parallel to the capacitor C1 so that the discharge is rapid for the initial stage of the discharge and gradually becomes slower toward the latter stage of the discharge at a rate factor than that in exponential function, this discharge circuit may be modified in various ways depending on requirements of the particular embodiment.

From the foregoing description, it will be seen that with the arrangment of FIG. 16 it is possible to effect change-over between a piano mode in which the envelope of the note starts to be attenuated form the initial stage of the key depression and an organ mode in which the magnitude of the note is not varied according to the depressing speed of the keys and the envelope of the note remains constant during the entire period of the key depression, and also between a mode wherein the note disappears upon release of the depressed keys and a mode wherein the attenuating note remains even after the release of the depressed keys.

As is clear from the foregoing description, according to the present invention, the information of the actuation of the keys in electronic musical instruments of the keyboard scanning type can be memorized by an extremely simple circuit construction. It is another advantage of the present invention that the tone generator circuit of the electronic musical instrument may be readily formed upon an integrated circuit of one chip. Additionally, since the information of the actuation of the keys is dynamically memorized in the gate capacitance or the like of the MOS transistor, the tone generator circuit of the electronic musical instrument can be constituted by a very simple circuit suitable for formation into integral circuits. Furthermore, in the arrangements according to the present invention, the tone generator section can be formed with a simple circuit construction by memorizing the information of the actuation of keys in a latch circuit having a one to one correspondence to the plurality of keys. Moreover, by incorporating in the keyboard matrix a group of switches having functions such as tone color change-over so that the scanning of these switches can be made simultaneously with the same scanning routine as for the keyboard scanning, various functions such as the variation of tones, cutting off of the four-foot group tones when not in use, etc., can be achieved without increasing the number of terminals, this arrangement being extremely suitable for the formation of LS1.

On the whole, according to the arrangements of the present invention, the following functions can be achieved in electronic musical instruments in which a group of the keyboard contacts arranged in the form of matrix is employed.

(1) The tone envelope can be controlled at will.

(2) A tone magnitude corresponding to the speed of key depression is available.

(3) Since the electrical charge discharging variable impedance elements for envelope control are simultaneously used for a plurality of keys, the number thereof may be smaller than the number of keys.

(4) Since the discharging of the electrical charge for the envelope control is effected intermittently, the capacitance of the charge accumulating capacitor may have a small value.

(5) The function of erasing the tone from the key releasing information can be readily achieved.

(6) It is possible to effect a change-over between a piano mode wherein the envelope of the tone starts to be attenuated from the initial stage of the key depression and an organ mode wherein the magnitude of the tone does not vary according to the depression speed of the keys with the envelope of the tone remaining constant during the period in which the key is depressed.

(7) It is also possible to effect a change-over between a mode wherein the tone disappears upon release of the depressed key and a mode wherein the attenuating tone continues even after the release of the depressed key.

Although the present invention has been fully described by way of example with reference to the attached drawings, note that various changes and modifications are apparent to those skilled in the art. Therefore, unless such changes and modifications otherwise depart from the scope of the present invention they should be construed as included therein.

What is claimed is:

1. An electronic musical instrument comprising:

a plurality of selectively actuable keying means, each of said keying means corresponding to a single musical note;

a scanning means connected to said plurality of keying means for sequentially scanning said keying means for detection of the actuation of said keying means;

a memory means connected to said scanning means having a plurality of capacitive elements, each of said capacitive elements corresponding to one of said plurality of keying means and storing a predetermined electrical charge when said scanning means detects the actuation of said corresponding keying means;

an electrical discharging means connected to said memory means for sequential connection to each of said capacitive elements for partial discharge of said electrical charge stored therein; and a plurality of musical tone generators, each connected to a corresponding one of said capacitive elements, each for generation of a musical tone signal having a frequency proportional to said corresponding musical note and an amplitude proportional to said charge stored in said corresponding capacitive element.

2. An electronic musical instrument as claimed in clain 1, wherein:

said scanning means comprises means for sequential detection of the actuation of said keying means one by one.

3. An electronic musical instrument as claimed in claim 1, wherein:

said scanning means comprises means for sequential detection of the actuation of said keying means at a rate outside the audio frequency range and outside a range of the frequencies of said musical tone signals.

4. An electronic musical instrument as claimed in claim 1, wherein:

said memory means has a plurality of MOS transistors at least as great in number of said capacitive elements, said MOS transistors having gate capacitance for functioning as said capacitive elements.

5. An electronic musical instrument as claimed in claim 1, wherein:

said memory means has a plurality of MOS transistors at least as great in number as the number of said capacitive elements, said MOS transistors having gate capacitance, wiring capacitance and parasitic capacitance for functioning as said capacitive elements.

6. An electronic musical instrument as claimed in claim 1, wherein:

said electrical discharging means is connected to said scanning means, said electrical discharging means comprising an impedance element sequentially connected to said capacitive element corresponding to said keying means scanned by said scanning means.

7. An electronic musical instrument as claimed in claim 1, wherein:

said scanning means comprises means for scanning each of said keying means for a predetermined period of time during said sequential scanning of said keying means.

8. An electronic musical instrument as claimed in claim 1, wherein each of said keying means comprises:

a voltage source;

a selectively depressable key;

a first keyboard switch means selectively actuable by depression of said key, having a common terminal, a normally open terminal, and a normally closed terminal connected to said voltage source, whereby said common terminal is first disconnected from said normally closed terminal and then connected to said normally open terminal upon depression of said key;

a first capacitor connected to said common terminal of said first keyboard switch means for storing an electrical charge therein, said first capacitor storing a predetermined charge from said voltage source when said key is no depressed;

a discharge means connected in parallel with said first capacitor, for discharge of said charge stored in said first capacitor;

a second capacitor connected to said normally open terminal of said first keyboard switch means, for storing a charge therein proportional to said charge stored in said first capacitor when said first keyboard switch means connects said common terminal to said normally open terminal, said charge stored in said first capacitor then being proportional to the speed of depression of said key; and wherein said scanning means comprises means for detection of the actuation of said keying means by detecting the charge stored in said corresponding second capacitor and said memory means comprises means for storing an electrical charge in said corresponding capacitive element proportional to said charge stored in said second capacitor.

9. An electronic musical instrument as claimed in claim 8, wherein said keying means further comprises:

a second keyboard switch means selectively actuable by depression of said key, connected to said second capacitor for storing a predetermined charge in said second capacitor when said key is not depressed.

10. An electronic musical instrument as claimed in claim 1, wherein said plurality of keying means are disposed at intersection points of a keyboard matrix comprising a plurality of column lines and a plurality of row lines and each of said keying means comprises:

a voltage source;

a selectively depressable key;

a first keyboard switch means selectively actuable by depression of said key, having a common terminal, a normally open terminal, and a normally closed terminal connected to said voltage source, whereby said common terminal is first disconnected from said normally closed terminal and then connected to said normally open terminal upon depression of said key;

a first capacitor, having a first terminal connected to said common terminal of said first keyboard switch means and a second terminal connected to said column line of said intersection point whereat said keying means is disposed, for storing a charge therein, whereby said first capacitor stores a predetermined charge from said voltage source when said key is not depressed;

a discharge means connected in parallel with said first capacitor for discharging said charge stored in said first capacitor;

a pn junction element havng a first terminal connected to said normally open terminal of said first keyboard switch means and a second terminal;

a second capacitor having a first terminal connected to said second terminal of said pn junction element and a second terminal connected to said column line of said intersection point, for storing a charge therein proportional to said charge stored in said first capacitor when said first keyboard switch means connects said common terminal to said normally open terminal, said charge stored in said first capacitor then being proportional to the speed of depression of said key;

a diode having a first terminal connected to said first terminal of said second capacitor and a second terminal connected to said row line of said intersection point;

said scanning means comprises means to sequentially apply a scanning signal to said column lines one by one, whereby said row line of said intersection points whereat said key is depressed has a voltage placed thereon proportional to said charge stored in said second capacitor when said scanning means applies said scanning signal to the corresponding column line, said scanning means further comprising means for detection of said voltage placed on said row lines; and said memory means comprises means for storing an electrical charge in said corresponding capacitive element proportional to said voltage placed on said row line.

11. An electronic musical instrument as claimed in claim 5, wherein said plurality of keying means are disposed at intersection points of a keyboard matrix comprising a plurality of column lines and a plurality of row lines, and each of said keying means comprises:

a capacitor having a first terminal connected to said column line of said intersection point whereat said keying means is disposed and a second terminal;

a diode having a first terminal connected to said second terminal of said capacitor and a second terminal connected to said row line of said intersection point;

a voltage source;

a selectively actuable keyboard switch means connected to said voltage source and said second terminal of said capacitor;

said electrical discharging means further connected to said plurality of row lines, whereby each of said capacitors is selectively charged by said corresponding keyboard switch means and selectively discharging by said electrical discharging means;

said scanning means comprises means to sequentially apply a scanning signal to said column lines one at a time and means for detection of the actuation of said keying means by detecting the voltage on said corresponding row lines; and said memory means comprises means to store a charge on said capacitive elements proportional to said voltage on said row line corresponding to said corresponding keying means when said scanning means aplies said scanning signal to said column line corresponding to said corresponding keying means.

12. An electronic musical instrument as claimed in claim 1, wherein each of said keying means comprises:

a selectively depressable key;

first and second voltage sources;

a first keyboard switch means selectively actuable by depression of said key, having a common terminal, a normally closed terminal, and a normally open terminal connected to said first voltage source, whereby said common terminal is first disconnected from said normally closed terminal and then connected to said normally open terminal upon depression of said key;

a first capacitor having a first terminal connected to said common terminal of said keyboard switch means and a second terminal connected to said second voltage source, for storing a charge therein, whereby said first capacitor stores a predetermined charge from said first and second voltage sources when said key is not depressed;

a discharge means connected in parallel with said first capacitor for discharging said charge stored in said first capacitor;

a second capacitor connected to said normally open terminal of said keyboard switch means, for storing a charge therein proportional to said charge stored in said first capacitor when said first keyboard switch means connects said common terminal and said normally open terminal; and wherein said scanning means comprises means for detection of the actuation of said keying means by detecting said charge stored in said corresponding second capacitor and said memory means comprises means for storing an electrical charge in said corresponding capacitive element proportional to said charge stored in said second capacitor.

13. An electronic musical instrument as claimed in claim 12, wherein:

said second voltage source has a voltage selectively settable at a voltage close to the voltage of said first power source or a voltage close to the voltage across said second capacitor when said scanning means is not detecting said charge stored in said second capacitor.

14. An electronic musical instrument as claimed in claim 12, wherein said keying means further comprises:

a third voltage source;

a diode having a first terminal connected to said second capacitor and a second terminal;

a second keyboard switch means selectively actuable by depression of said key, having a first terminal connected to said third voltage source and a second terminal connected to said second terminal of said diode, said first and second terminals being connected when said key is not depressed and disconnected when said key is depressed, whereby said second capacitor stores a predetermined charge from said third voltage source when said key is not depressed.

15. An electronic musical instrument as claimed in claim 14, wherein:

said second voltage source has a voltage selectively settable at a voltage close to the voltage of said first power source or a voltage close to the voltage across said second capacitor when said scanning means is not detecting said charge stored in said second capacitor.

16. An electronic musical instrument as claimed in claim 14, wherein:

said third voltage source has a voltage selectively settable at a voltage close to the voltage of said first voltage source of a voltage close to the voltage or maintaining said diode in a cut off state.

* * * * *